US007377379B2

(12) United States Patent
Kojima

(10) Patent No.: US 7,377,379 B2
(45) Date of Patent: May 27, 2008

(54) TRANSPORT BELT DRIVE CONTROL DEVICE, IMAGE FORMING DEVICE, AND TRANSPORT BELT DRIVE CONTROL METHOD

(75) Inventor: Hideyuki Kojima, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 298 days.

(21) Appl. No.: 11/271,834

(22) Filed: Nov. 14, 2005

(65) Prior Publication Data

US 2006/0119695 A1 Jun. 8, 2006

(30) Foreign Application Priority Data

Nov. 15, 2004 (JP) ..... 2004-331089
Oct. 28, 2005 (JP) ..... 2005-315060

(51) Int. Cl.
*B65H 7/00* (2006.01)

(52) U.S. Cl. ..... 198/810.03; 198/832; 318/602; 318/603

(58) Field of Classification Search ..... 198/832, 198/810.03; 318/602, 603, 652
See application file for complete search history.

(56) References Cited

U.S. PATENT DOCUMENTS 5,096,044 A * 3/1992 Biebel ..... 198/502.4
5,347,348 A * 9/1994 Nagata ..... 399/329
5,940,105 A * 8/1999 Hayami ..... 347/104
6,846,058 B2 * 1/2005 Claramunt et al. ..... 347/16
7,104,710 B2 * 9/2006 Otsuka ..... 400/76
7,221,114 B2 * 5/2007 Kojima ..... 318/34
2005/0150747 A1 * 7/2005 Menendez et al. ..... 198/810.03

FOREIGN PATENT DOCUMENTS

JP 07-243870 9/1995
JP 2001-253132 9/2001

* cited by examiner

*Primary Examiner*—Mark A. Deuble
(74) *Attorney, Agent, or Firm*—Harness, Dickey & Pierce, P.L.C.

(57) ABSTRACT

In a transport belt drive control device, a first detection unit has a first resolution and indirectly detects a feed amount of a transport belt, a control unit controls drive of the transport belt based on an output of the first detection unit, and a second detection unit has a second, lower resolution and directly detects the feed amount of the transport belt. The control unit is configured to switch, when an output of the second detection unit is determined as not allowing detection of a stop position of the transport belt, the direct detection of the belt feed amount by the second detection unit to the indirect detection of the belt feed amount by the first detection unit, so that the drive of the transport belt is controlled based on the output of the first detection unit.

10 Claims, 16 Drawing Sheets

MOTOR OPERATION
STOP SIGNAL
EDGE OF D.E.S. SIGNAL
COUNT PULSE OF D.E.S. SIGNAL COUNTER
COUNT VALUE OF D.E.S. SIGNAL
RESET PULSE
4X PULSE OF I.E.S. SIGNAL
COUNT VALUE OF I.E.S. SIGNAL
NEGLECT
NEGLECT
NEGLECT
D.E.S. SIGNAL EDGE AFTER STOP SIGNAL IS NEGLECTED. NO INCREMENT OF COUNT VALUE
49TH
50TH
47
48
49
50
AFTER STOP SIGNAL, NO RESET OF ROTARY COUNTER
0
0
0

TRANSPORT BELT DRIVE CONTROL DEVICE, IMAGE FORMING DEVICE, AND TRANSPORT BELT DRIVE CONTROL METHOD

This U.S. non-provisional application claims benefit of priority under 35 U.S.C. §119 of Japanese Patent Application No. 2004-331089, filed on Nov. 15, 2004, and Japanese Patent Application No. 2005-315060, filed on Oct. 28, 2005, the entire contents of which are incorporated herein by reference.

BACKGROUND OF THE INVENTION

1. Field of the Invention

The present invention generally relates to a transport belt drive control device, an image forming device, and a transport belt drive control method. More specifically, the present invention relates to the a transport belt drive control device, an image forming device, and a transport belt drive control method, which controls drive of a transport belt for transporting a recording medium in an image forming device of an ink jet recording method.

2. Description of the Related Art

Generally, in an image forming devices, such as an ink-jet printer, an image formation is performed on a recording medium (for example, paper) by a width equivalent to the nozzle width of the ink jet head, and thereafter the recording medium is transported in the sub-scanning direction and stopped by controlling drive of the transport belt. This procedure is repeatedly carried out, and finally a desired image is formed on the recording medium of one sheet.

In recent years, with the improvements of light resistance of ink and degradation effects of time on ink, the ink is changed from the dye type to the pigment type, and, moreover, the use of high-viscosity ink is progressing.

Although the blotting of ink to the recording medium is decreased sharply by the use of high-viscosity ink, poor accuracy of the positions of ink drops discharged to the recording medium causes the appearance of the printed image to deteriorate (white stripe, black stripe, banding). Especially, the contribution of the stop position accuracy at the time of transporting the recording medium in the sub-scanning direction is large, the increase in the stop position accuracy has been the indispensable technical object of the image forming device.

Conventionally, for the recording medium transport mechanism in the image forming device of ink jet recording method, the transport method utilizing a conveyance roller or a transport belt has been commonly used. And the method of controlling the feed amount of the conveyance roller or the transport belt is that a cord wheel is disposed on a conveyance roller shaft, and an output of an encoder sensor indicating a movement of the cord wheel is read to control the feed amount of the roller or the belt.

There are several known methods of controlling the feed amount of the recording medium. For example, refer to Japanese Laid-Open Patent Application No. 07-243870.

FIG. 1 shows the composition of a conventional image forming device in which a feed amount control of the transport belt is performed to control the feed amount of a recording medium laid on the transport belt.

In the conventional image forming device of FIG. 1, the feed amount control of the transport belt is performed by reading an output of the indirect encoder sensor 225 which indicates a movement of the rotary scale 226 disposed on the circumference of the cord wheel 233 which is rotated by the drive motor 221.

For example, when the control of the belt feed amount equivalent to 1000 pulses is performed using a computation unit, such as a CPU, the feed amount control of the transport belt is performed as follow. The feeding of the transport belt by the drive motor 221 is continued until the counting of the rotary scale equivalent to 1000 pulses using the output of the indirect encoder sensor 225 is completed, and the electric supply to the drive motor 221 is stopped upon completion of the counting so that the movement of the transport belt 222 is stopped.

In the conventional image forming device of FIG. 1, the drive motor 221 and the cord wheel 233 are connected via the belt conveyance roller 38 by the belt 232. The left-hand end of the transport belt 222 is wound on the conveyance roller 38, and the right-hand end of the transport belt 222 is wound on the driven roller 231.

The feed and stop control of the transport belt 222 is performed by counting the rotary scale 226 disposed on the circumference of the cord wheel 233, using the output of the indirect encoder sensor 225. However, in this case, if a misalignment between the center of the cord wheel 233 and the center of the revolving shaft exists, then the counting of the same count value does not result in the same feed amount of the transport belt. Namely, a difference will arise in the feed amount of the transport belt.

FIG. 2 is a diagram for explaining the problem of the conventional image forming device. For the sake of convenience of explanation, an extreme example is shown in FIG. 2.

As shown in FIG. 2, suppose that a misalignment between the true center X2 of rotation of the cord wheel 233 and the center X1 of rotation of the actually installed shaft has arisen. In this case, it is clear that a difference arises in the feed amount of the transport belt even if the same count value (for example, 1000 pulses) is counted for the rotary scale. Apart from an installation error as in the above example, a thermal expansion of the cord wheel 233 according to environmental conditions and an error of the molded thickness of the transport belt 222 from a given design thickness may be the factors affecting the accuracy of the feed amount of the transport belt. In such case, even if the counting of the same count value is performed by using the output of the indirect encoder sensor 225, it is difficult to control the feed amount of the transport belt 222 to a fixed amount with good accuracy.

SUMMARY OF THE INVENTION

An object of the present invention is to provide an improved image forming device in which the above-described problems are eliminated.

Another object of the present invention is to provide a transport belt drive control device and method, and an image forming device which attain high-accuracy control of the feed amount of a transport belt to a fixed amount.

In order to achieve the above-mentioned objects, the present invention provides a transport belt drive control device comprising: a first detection unit having a first resolution and indirectly detecting a feed amount of a transport belt; a control unit controlling drive of the transport belt based on an output of the first detection unit; and a second detection unit having a second resolution lower than the first resolution and directly detecting the feed amount of the transport belt, wherein the control unit is configured to switch, when it is determined that an output of the second detection unit having the second resolution does not allow detection of a stop position of the transport belt, the direct detection of the transport belt feed amount by the second detection unit to the indirect detection of the transport belt feed amount by the first detection unit, so that the drive of the transport belt is controlled based on the output of the first detection unit.

In order to achieve the above-mentioned objects, the present invention provides an image forming device in which an image recording unit forms an image on a recording medium transported by a transport belt, and a transport belt drive control device controls drive of the transport belt, the transport belt drive control device comprising: a first detection unit having a first resolution and indirectly detecting a feed amount of a transport belt; a control unit controlling the drive of the transport belt based on an output of the first detection unit; and a second detection unit having a second resolution lower than the first resolution and directly detecting the feed amount of the transport belt, wherein the control unit is configured to switch, when it is determined that an output of the second detection unit having the second resolution does not allow detection of a stop position of the transport belt, the direct detection of the transport belt feed amount by the second detection unit to the indirect detection of the transport belt feed amount by the first detection unit, so that the drive of the transport belt is controlled based on the output of the first detection unit.

In order to achieve the above-mentioned objects, the present invention provides a transport belt drive control method comprising steps of: providing a first detection unit having a first resolution and indirectly detecting a feed amount of a transport belt; controlling drive of the transport belt based on an output of the first detection unit; and providing a second detection unit having a second resolution lower than the first resolution and directly detecting the feed amount of the transport belt, wherein the controlling step is configured to switch, when it is determined that an output of the second detection unit having the second resolution does not allow detection of a stop position of the transport belt, the direct detection of the transport belt feed amount by the second detection unit to the indirect detection of the transport belt feed amount by the first detection unit, so that the drive of the transport belt is controlled based on the output of the first detection unit.

According to the present invention, the direct encoder which detects the belt scale disposed on the transport belt is provided. When stopping the transport belt in the timing with the resolution higher than the resolution with which the direct encoder is detectable, the feed amount control of the transport belt is performed based on the detection value obtained from the indirect encoder having the resolution higher than that of the direct encoder. Therefore, the feed amount control and stop control of the transport belt on which the recording medium is carried can be performed with high accuracy.

BRIEF DESCRIPTION OF THE DRAWINGS

Other objects, features and advantages of the present invention will be apparent from the following detailed description when reading in conjunction with the accompanying drawings.

DETAILED DESCRIPTION OF PREFERRED EMBODIMENTS

A description will now be given of an embodiment of the invention with reference to the accompanying drawings.

Figure 1:
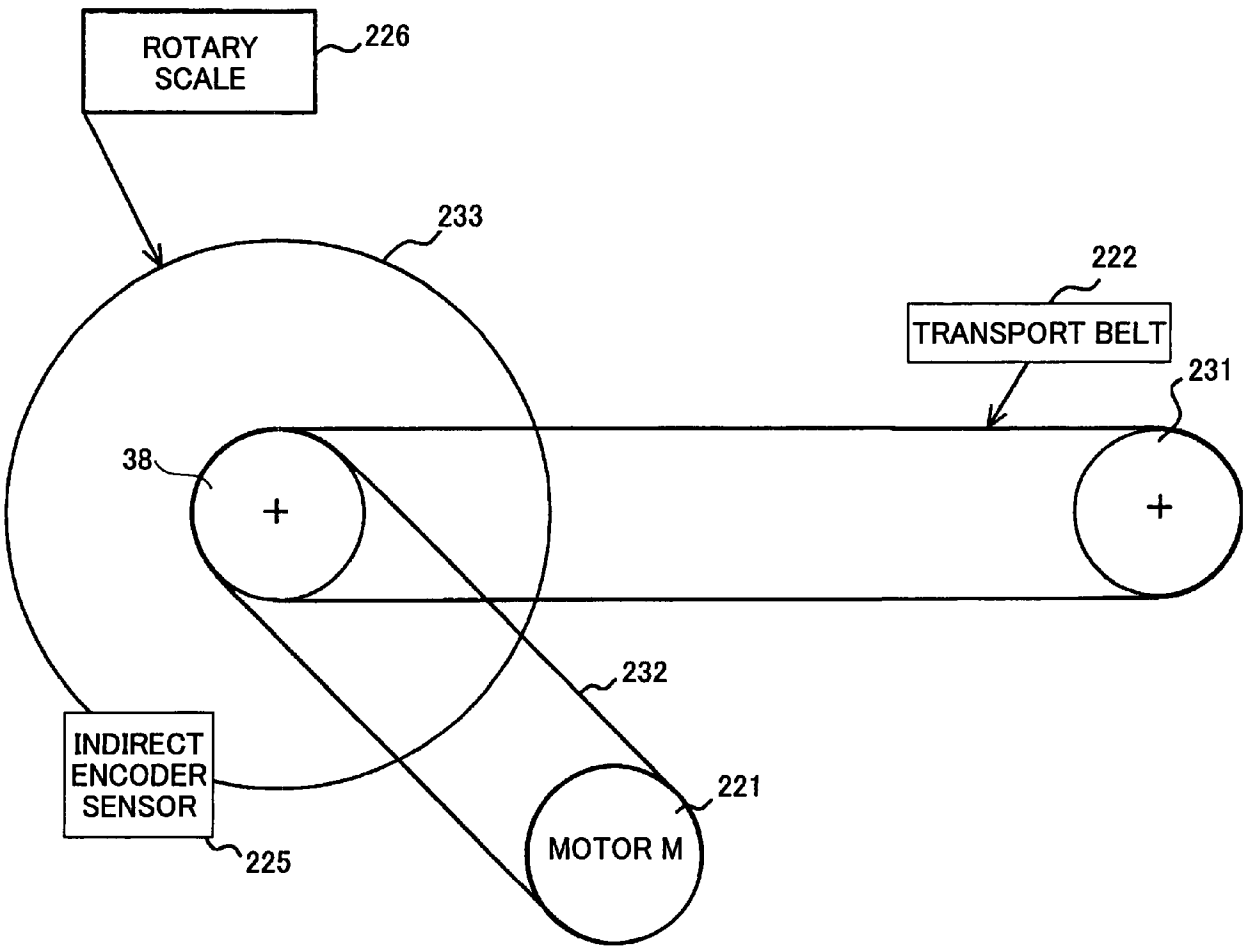
FIG.1 PRIOR ART
FIG. 1 is a block diagram showing the composition of a conventional image forming device.
Figure 2:
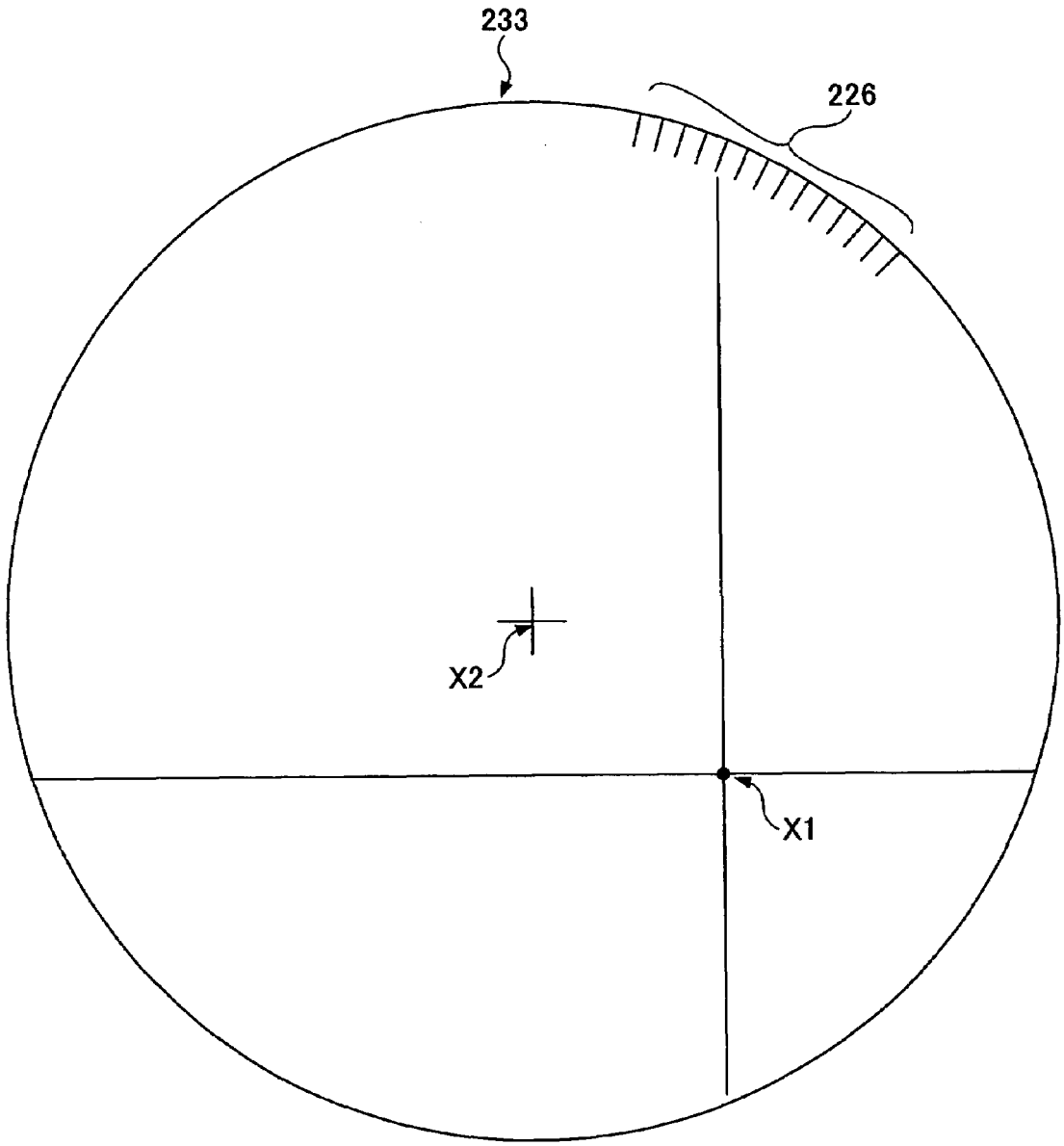
FIG.2 PRIOR ART
FIG. 2 is a diagram for explaining the problem of the conventional image forming device.
Figure 3:
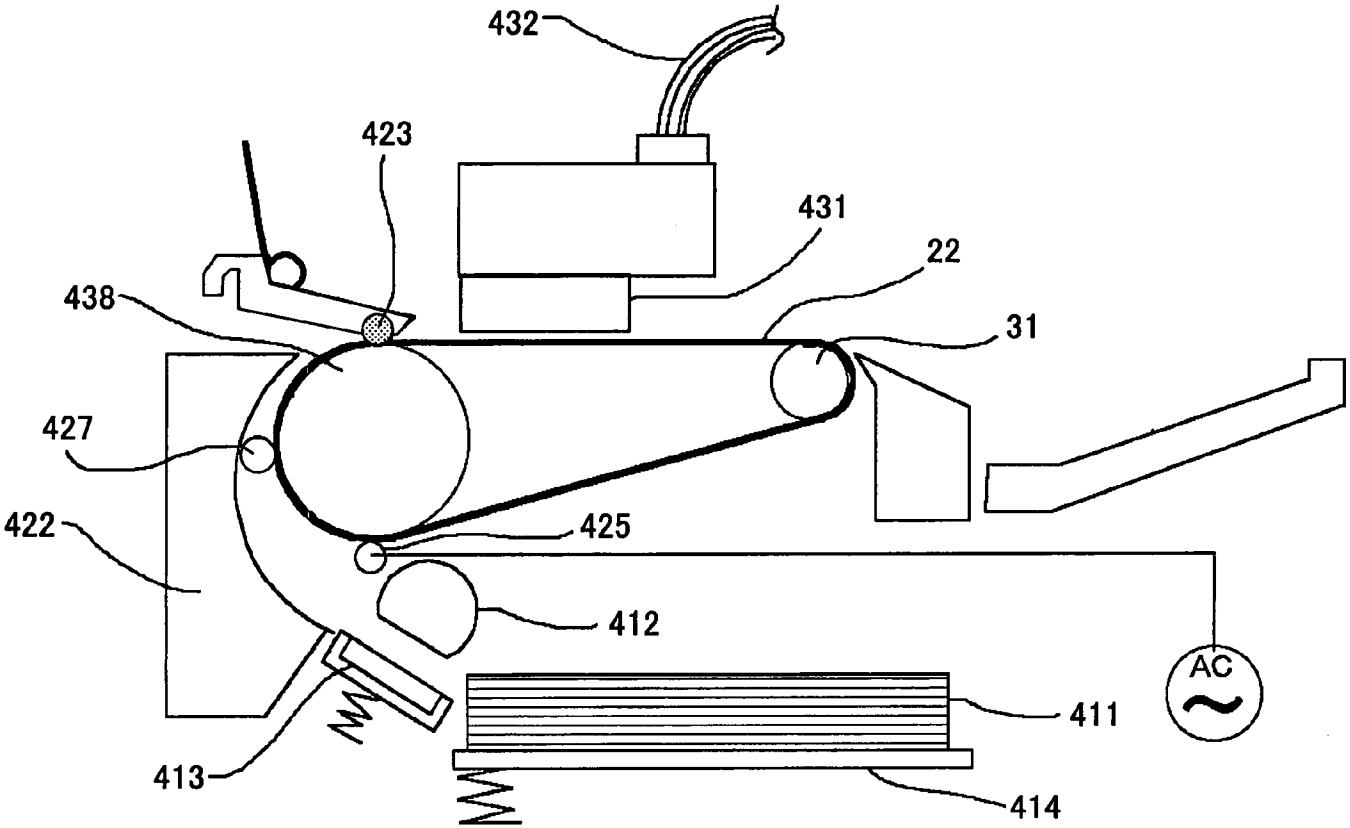
FIG. 3 is a diagram showing the composition of an image forming device in an embodiment of the invention.

FIG. 3 shows the composition of an image forming device in an embodiment of the invention. Specifically, this image forming device is constructed as a line printer using an ink jet printing method.

The image forming device has a line head 431 disposed in the position which confronts a transport belt 22 on which a recording medium (paper) 411 can be transported with high accuracy, and the ink from an ink tank disposed in a separate position is supplied through an ink supply pipe 432 to the line head 431.

The recording medium 411 is taken up by a feed roller 412 and separated from the remaining recording media 411 on the paper loading tray 414 by a paper separating pad 413. A sheet of the recording medium 411 separated is conveyed along the conveyance guide 422, and it is conveyed to the printing position by rotation of a belt conveyance roller 438 while it is pinched between the transport belt 22 and an edge roller 423.

The transport belt 22 is firmly laid between the conveyance roller 438 and the driven roller 22. The edge roller 423 is disposed in the position which confronts the conveyance roller 438. The edge roller 423 is provided to exert pressure on the transport belt 22 in the direction of the conveyance roller 438.

To the surface of the transport belt 22, the electric charge is supplied by a charging roller 425 while the recording medium 411 is conveyed to the printing position via the conveyance guide 22, and the recording medium 411 is electrostatically attracted by the transport belt 22 with the electric charge supplied thereto. And the recording medium 411 is pushed against the transport belt 22 by the edge roller 423, and the transport belt 22 and the recording medium 411 are conveyed without the gap with the efficient electrostatic attraction power to the recording head 431 which is a printing part of the image forming device.

The drive of the above-mentioned transport belt 22 is controlled by the transport belt drive control device in an embodiment of the invention. In the following, this transport belt drive control device will be referred to as the drive control device.

Figure 4:
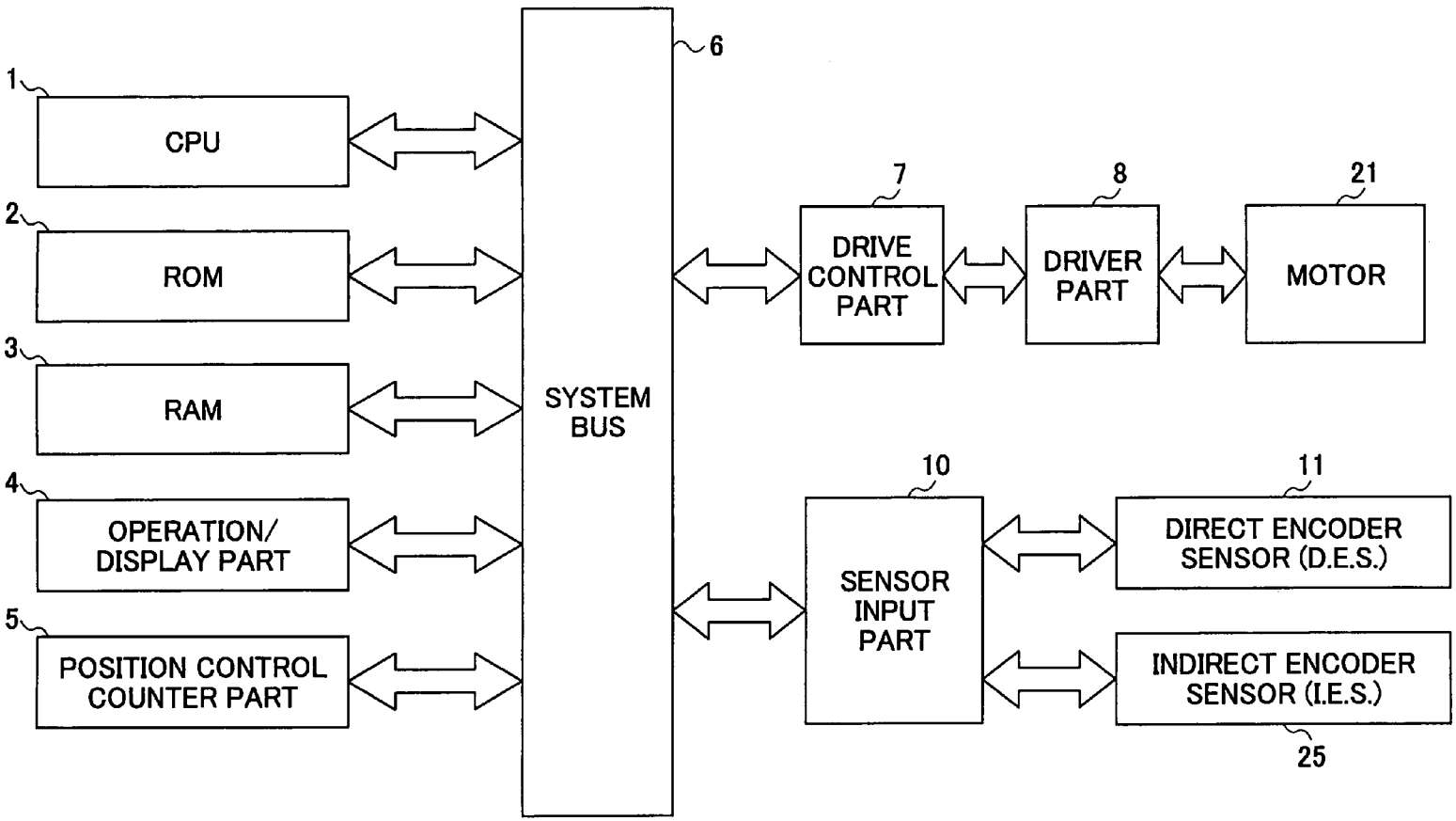
FIG. 4 is a block diagram of a transport belt drive control device in an embodiment of the invention.

A description will be given of the drive control device. FIG. 4 is a block diagram of the drive control device in this embodiment.

In FIG. 4, reference numeral 1 denotes a CPU which controls the whole drive control device, 2 denotes a ROM in which a program and data are stored, 3 denotes a RAM which is the memory for working areas, 4 denotes an operation/display part which is operated by the user and outputs the necessary operational display/information to the user, 5 denotes a position control counter part which processes an encoder sensor signal which is the output of each encoder sensor, which will be mentioned later.

Moreover, in FIG. 4, reference numeral 6 denotes a system bus, 7 denotes a drive control part which generates a PWM (pulse-width modulation) drive waveform to drive a motor 21 which will be mentioned later, and generates the excitation phase of a stepping motor, etc, and 8 denotes a driver part which is the motor drive circuit. In FIG. 4, reference numeral 10 denotes a sensor input part which removes the chattering of the incoming signals from each of encoder sensors 11 and 25, 11 denotes a direct encoder sensor (DES) which outputs a direct encoder sensor signal, and 25 denotes an indirect encoder sensor (IES) which outputs an indirect encoder sensor signal.

In the present embodiment, the indirect encoder sensor 12 has a high resolution (first resolution), and the direct encoder sensor 11 has a low resolution (second resolution) which is lower than the resolution of the indirect encoder sensor 12.

Figure 5:
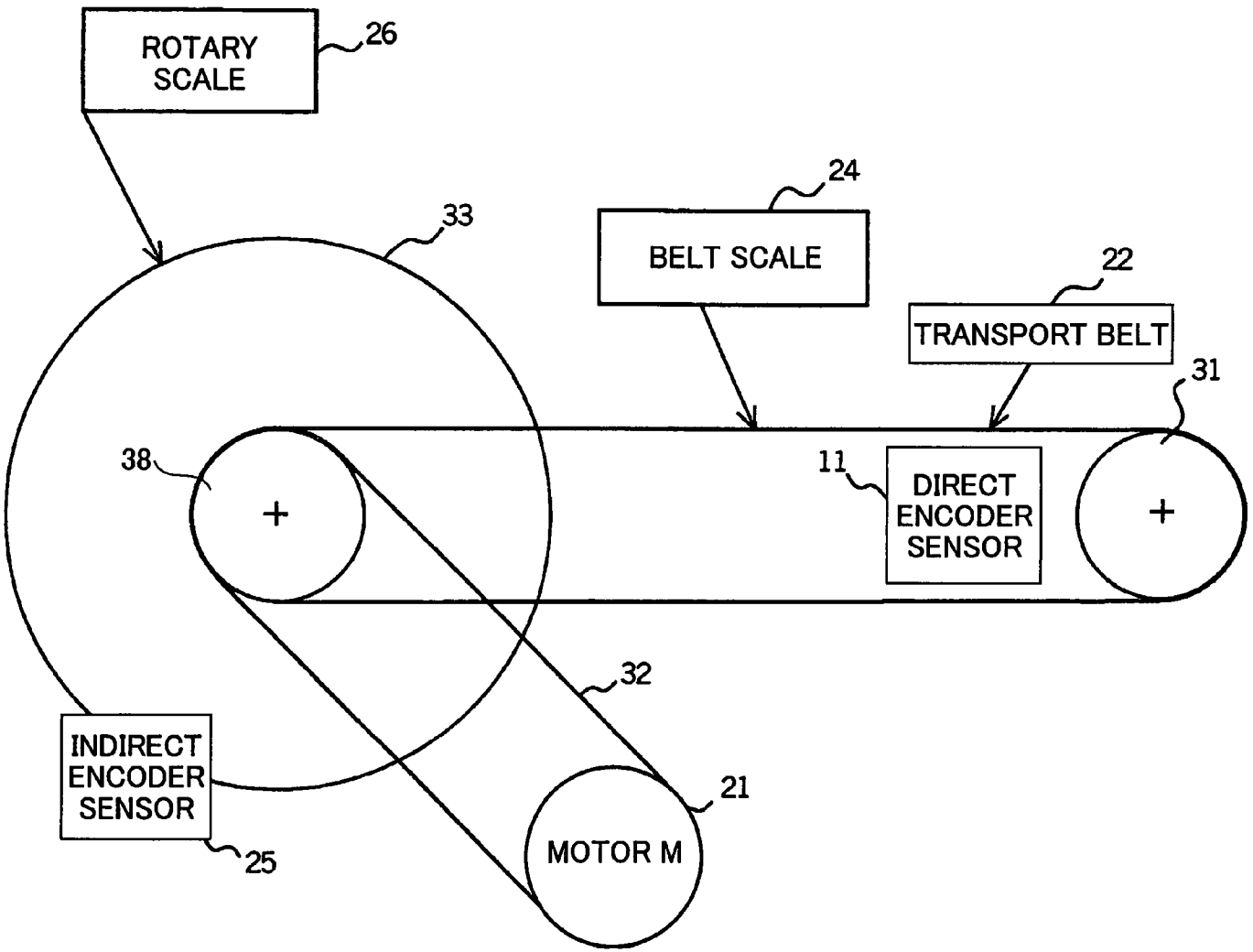
FIG. 5 is a block diagram showing the composition of the transport belt drive control device in an embodiment of the invention.

FIG. 5 is a block diagram showing the composition of the drive control device in an embodiment of the invention.

As shown in FIG. 5, the transport belt 22 which conveys the recording medium 411 is wound between the conveyance roller 38 and the driven roller 31. The conveyance roller 38 is rotated via the transport belt 32 by the motor (M) 21. The direct encoder sensor 11 reads the belt scale 24 disposed with a given interval on the back-side circumference of the transport belt 22.

The direct encoder sensor 11 has a low resolution which is lower than the resolution of the indirect encoder sensor 25. However, since the transport belt 22 directly conveys the recording medium 411, the conveyance or feed amount of the transport belt 22 can be controlled without the error by counting the output (direct encoder sensor signal) of the direct encoder sensor 11. In the belt scale 24, a line pattern of black and white scale lines at equal intervals is formed on the back-side circumference of the transport belt 22 (see FIG. 8).

The rotary scale 26 is disposed with a given interval on the circumference of the cord wheel 33, and this cord wheel 33 is provided on the revolving shaft coaxially with the conveyance roller 38. The indirect encoder sensor 25 reads this rotary scale 26. In the rotary scale 26, a line pattern of transparence and black lines at equal intervals is formed on the outer circumference of the cord wheel 33.

Although the indirect encoder sensor 25 has a high resolution, it is provided to read the rotary scale 26 on the circumference of the cord wheel 33 which is provided coaxially with the conveyance roller 38 being driven, instead of reading the belt scale 24 on the transport belt 22 which conveys the recording medium 411 directly. For this reason, an error may be included in the output (or the indirect encoder sensor signal) of the indirect encoder sensor 25.

The above-mentioned error may arise due to the influences of component accuracy errors and installation accuracy errors, such as eccentricity, deflection and temperature changes of the conveyance roller, deflection and temperature changes of the driving pulley and the cord wheel, and thickness variation of the transport belt, etc. If such error is mixed with the detection signal, it is difficult to carry out the drive control of the conveyance belt 22 with high accuracy by using the output of the indirect encoder sensor 25 having the high resolution.

Figure 6:
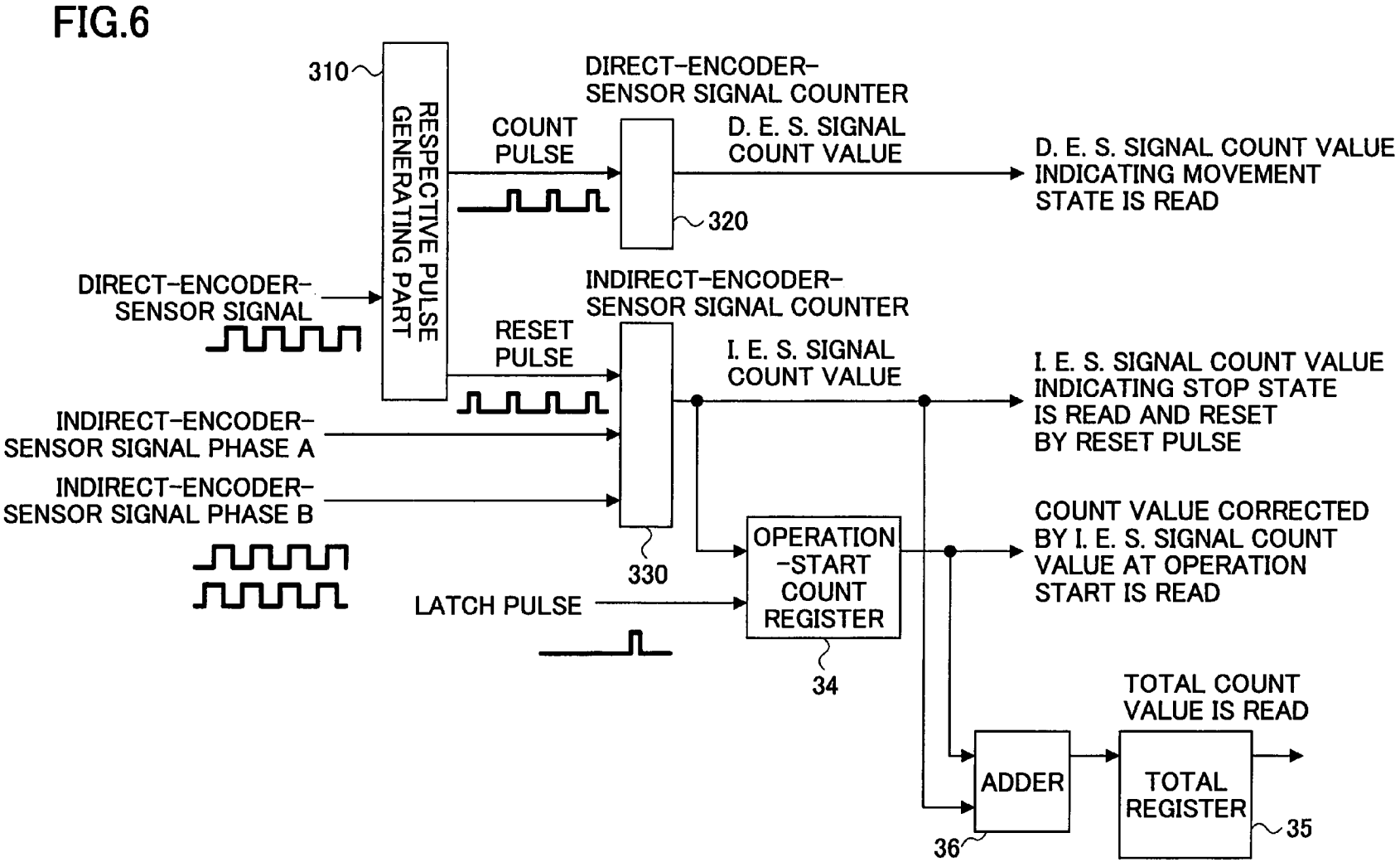
FIG. 6 is a block diagram of the position control counter part of the image forming device in an embodiment of the invention.

FIG. 6 is a block diagram of the position control counter part 5 of the image forming device in an embodiment of the invention.

In the position control counter part 5 of FIG. 6, the respective pulse generation part 310 generates, based on the incoming direct encoder sensor signal, the count pulse to the direct encoder sensor signal counter 320, the reset pulse to the indirect encoder sensor signal counter 330, and the latch pulse to the operation-start count register 34.

The direct encoder sensor signal counter 320 counts the count pulse generated by the respective pulse generating part 310 according to the edge of the direct encoder sensor signal. The indirect encoder sensor signal counter 330 counts the four-fold frequency indirect encoder sensor signal. The indirect encoder sensor signal has the two phases (the phase A and the phase B) which are different by 90 degrees, and the detection of the edges of the phase A and the phase B allows the four-fold frequency indirect encoder sensor signal to be created. The counting of this indirect encoder sensor signal counter 330 is reset by the reset pulse obtained from the respective pulse generating part 310 at the timing of the direct encoder sensor signal.

The operation-start count register 34 retains a count value of the indirect encoder sensor signal counter 330 from the start of operation to the reception of the first reset pulse obtained from the respective pulse generating part 310. That is, the count value retained in the register 34 is corrected with the counter having the high resolution. The sum total register 35 is an register for bringing the soft processing forward and lessening the time lag of the sampling and processing. The adder 36 adds the value of the operation-start count register 34 to the count value of the indirect encoder sensor signal counter 330, and outputs the resulting sum (or the total count value) to the sum total register 36.

Next, the transport belt drive control processing of the drive control device of the above-mentioned embodiment will be explained with reference to FIG. 7 and FIG. 8.

As described above, in the drive control device of this embodiment, by detecting the belt scale 24 on the transport belt 22 by using the direct encoder sensor 11, a more accurate belt drive control is enabled when compared with the example in which only the indirect encoder sensor 25 which detects the rotary scale 26 is used.

However, the direct encoder sensor 11 has a low resolution which is lower than the resolution of the indirect encoder sensor 25, and there is a difficulty in detecting a stop position of the transport belt with high accuracy when compared with the example in which the stop position of the transport belt is detected using the indirect encoder sensor 25 only.

Figure 7:
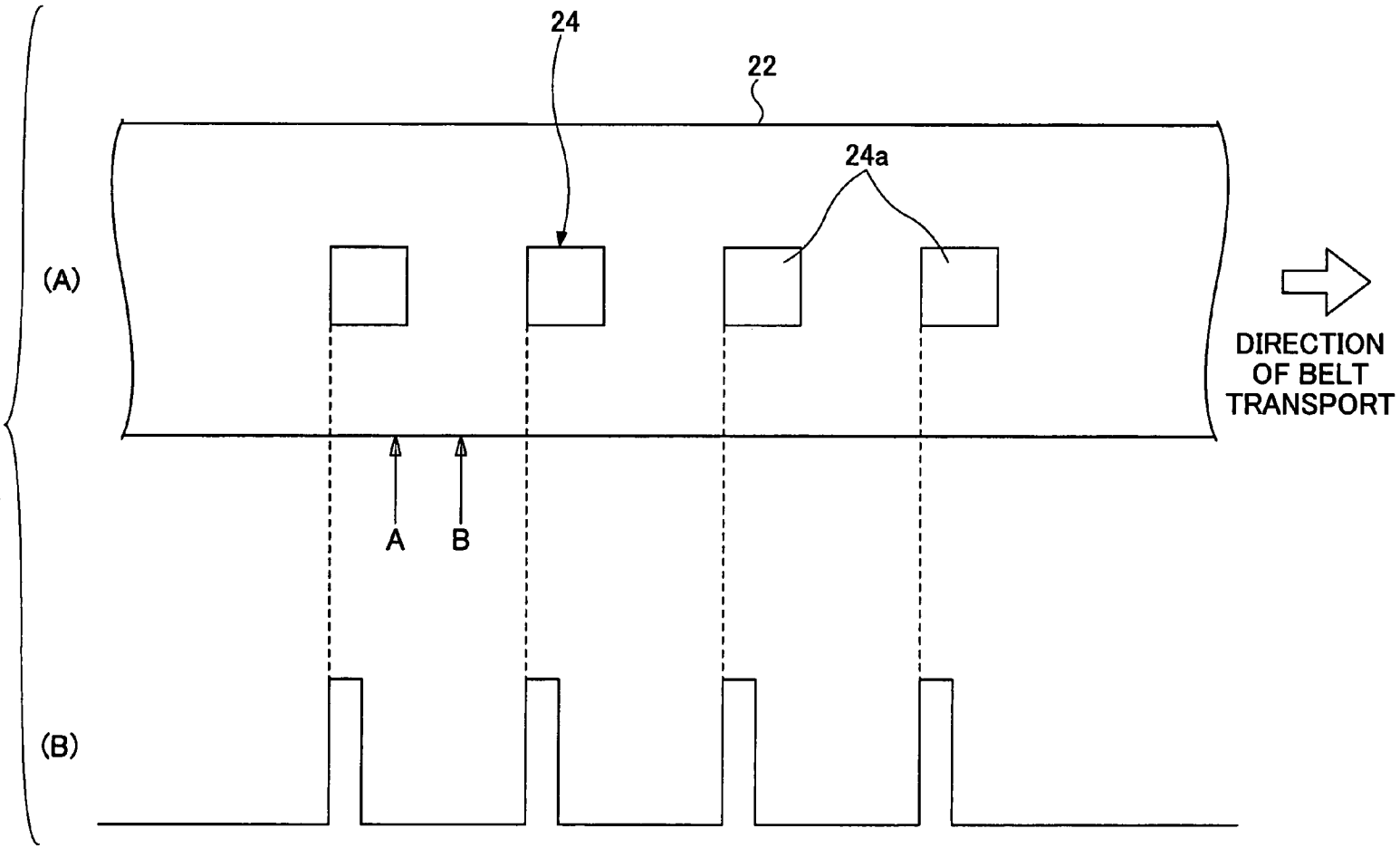
FIG.7 PRIOR ART
FIG. 7 is a diagram for explaining the control processing of the transport belt drive control device in the conventional image forming device.

For example, in the conventional example, as indicated in (A) in FIG. 7, when the direct encoder sensor 11 detects the belt scale 24 on the transport belt 22, the light is emitted to each reflection part 24*a* of the rectangular shape which constitutes the belt scale 24. This reflection part 24*a* is colored in white or silver, and the light from the direct encoder sensor 11 is reflected by the reflection part 24*a*, and the reflected light is detected by the direct encoder sensor 11.

Specifically, the pulse is generated when the edge of the reflection part 24*a* (or the edge of the rear end of the reflection part 22*a* in the direction of movement of the transport belt 22) is detected as indicated in (B) in FIG. 7. And, by counting this pulse, the transport belt feed amount control is performed.

Thus, the direct encoder sensor signal outputted from the direct encoder sensor 11 is to detect the movement of the transport belt 22 (or the movement of the record medium 411) directly, and there is little influence of the error. Therefore, by performing the drive control of the transport belt 22 using the direct encoder sensor 11, it is possible to perform the drive control with high accuracy.

However, the intervals of pulse detection of the direct encoder sensor 11 which may vary depending on the sensor design are several times or several tens times longer than the intervals of pulse detection in the case where the indirect encoder sensor 25 having a high resolution is used. For this reason, the detection of the direct encoder sensor 11 cannot allow detection of a difference in the stop position with good accuracy between the case where the transport belt 22 is stopped at the position indicated by the arrow A in (A) in FIG. 7 and the case where the transport belt 22 is stopped at the position indicated by the arrow B in (A) in FIG. 7.

To avoid the problem, in the above-described embodiment, both the direct encoder sensor 11 and the indirect encoder sensor 25 are used and the desired characteristics of the two encoder sensors 11 and 25 are set in combination, and the undesired characteristics of the two encoder sensors 11 and 25 are canceled by each other.

Next, the control processing of the drive control device in this embodiment with be explained with reference to FIG. 8. Suppose the case in which the transport belt 22 is moved in the rightward direction from the start position indicated by the arrow in FIG. 8, and the transport belt 22 is stopped at the stop position indicated by the arrow in FIG. 8.

As described above, in this embodiment, the start position and the stop position are not in agreement with the edges of the reflection part 24*a* (or the edges of the front end of the reflection part 24*a* in the direction of movement of the transport belt 22 in this embodiment). For this reason, in the drive control using only the direct encoder sensor 11, it is difficult to perform the stop control of the transport belt 22 correctly at the stop position.

To eliminate the problem, the stop control of the transport belt 22 is performed by using the direct encoder sensor 11 and the indirect encoder sensor 25 in combination.

The movement distance of the transport belt 22 and the count value detected by the indirect encoder sensor 25 are predetermined in accordance with the interval of the rotary scale 26. For example, in this embodiment, when the transport belt 22 is moved by the distance of 10.0 mm, the count value output by the indirect encoder sensor 25 is 200 pulses, and this control data is stored beforehand in the memory unit such as the RAM 3 of the image forming device of FIG. 4.

Figure 8:
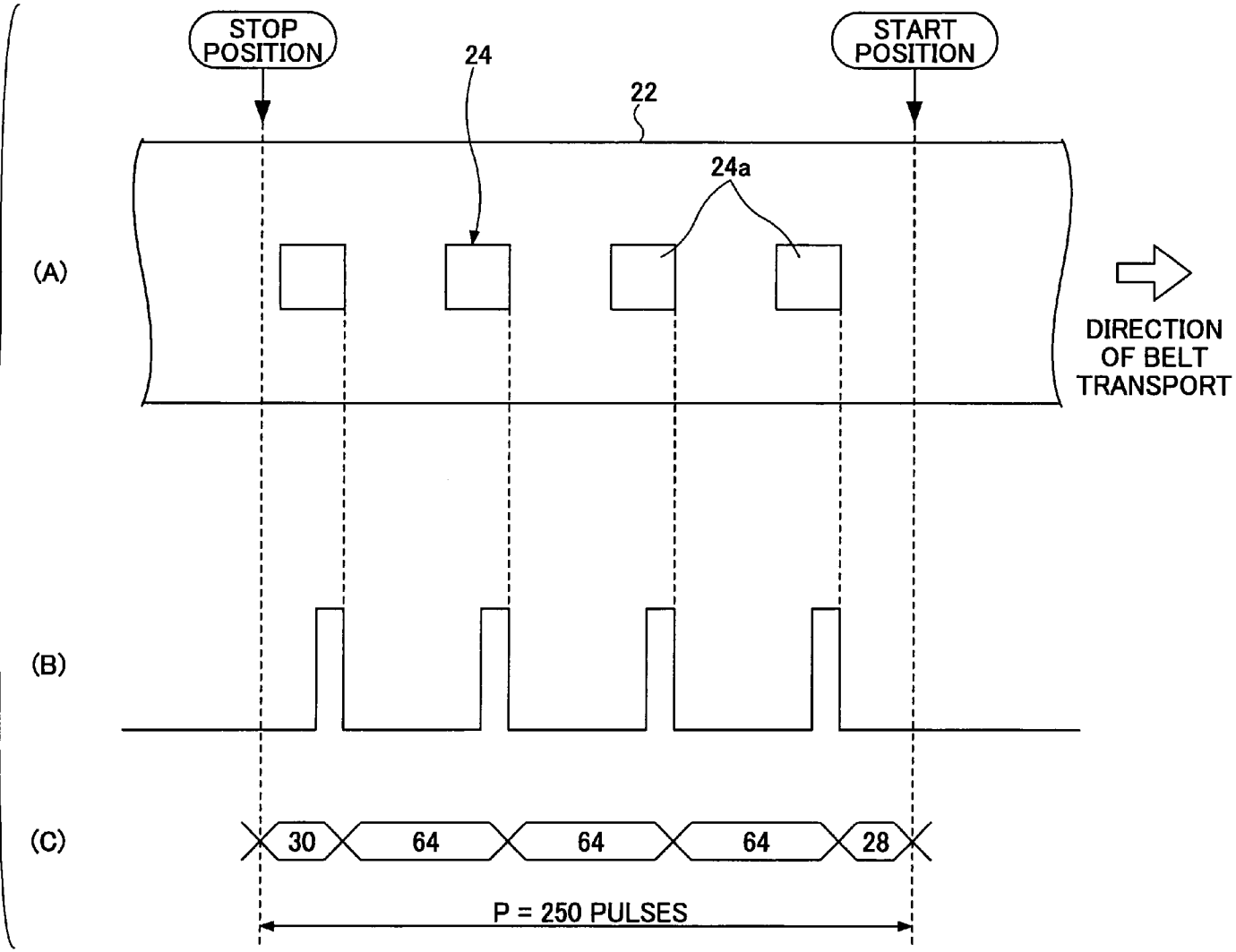
FIG. 8 is a diagram for explaining the control processing of the transport belt drive control device in an embodiment of the invention.

Suppose that, in the example of FIG. 8, the movement distance of the transport belt 22 from the start position to the stop position is 12.5 mm. The CPU 1 (see FIG. 4) converts the movement distance from the start position to the stop position into a count value which is outputted by the indirect encoder sensor 25 (the resulting count value by this conversion operation will be called the reference stop value P).

As mentioned above, in this embodiment, when the transport belt 22 is moved by the distance of 10.0 mm, the 200 pulses are outputted by the indirect encoder sensor 25. The resulting count value for the indirect encoder sensor 25 by the conversion of the movement distance from the start position to the stop position will be the 250 pulses.

On the other hand, the direct encoder sensor 11 has a low resolution which is lower than the resolution of the indirect encoder sensor 25, and the period of one pulse of the direct encoder sensor 11 is longer than the period of one pulse of the indirect encoder sensor 25. In this embodiment, as shown in (B) and (C) in FIG. 8, while the direct encoder sensor signal counter 320 counts one pulse, the indirect encoder sensor signal counter 330 counts 64 pulses.

When the feeding control of the transport belt 22 has just been started on the above-mentioned conditions, the CPU 1 controls the sensor input part 10 so that the drive control is performed based on both the signal outputted by the direct encoder sensor 11 and the signal outputted by the indirect encoder sensor 25.

Specifically, by controlling the position control counter part 5, the CPU 1 subtracts from the reference stop value P a count value outputted by the indirect encoder sensor signal counter 320 until a first direct encoder pulse signal from the start position is detected. Supposing that the count value outputted by the indirect encoder sensor signal counter 320 until the first direct encoder pulse signal from the start position is detected is 28 counts, the reference stop value P is set to $P=250-28=222$ by the subtraction processing of the CPU 1 when the first direct encoder pulse signal is detected.

After the first direct encoder pulse signal is detected and the subtraction processing of the reference stop value P is performed as described above, the CPU 1 performs the drive control of the transport belt 22 based on the signal outputted from the direct encoder sensor 11. That is, the CPU 1 continuously subtracts from the reference stop value P "64" which is an output count value of the indirect encoder sensor 25 corresponding to the period of one pulse of the direct encoder sensor 11, whenever the count value of the direct encoder sensor 11 is incremented.

Therefore, when the Nth direct encoder pulse signal from the direct encoder sensor 11 is detected after the movement of the transport belt 22 is started, the reference stop value P is set to $P=222-64\times(N-1)$. After the subtraction processing is performed, the CPU 1 determines whether the reference stop value P after subtraction is less than "64".

Since the reference stop value P in this embodiment is equal to $P=222$ when the first direct encoder pulse signal is detected, the reference stop value P when the 4th direct encoder pulse signal is detected is set to $P=222-64\times(4-1)=30$, and the reference stop value P at this time is less than "64". Thus, if the reference stop value P is less than the count value of the output pulses of the indirect encoder sensor 25 corresponding to the period of one pulse of the direct encoder sensor 11, the stop control of the transport belt 22 can no longer be performed by using the direct encoder sensor 11.

For this reason, by controlling the sensor input part 10, the CPU 1 stops operation of the direct encoder sensor 11 and switches the direct detection of the feed amount of the transport belt 22 by the direct encoder sensor 11 to the indirect detection of the feed amount of the transport belt 22 by the indirect encoder sensor 25, so that the drive of the transport belt 22 is controlled based on only the output of the indirect encoder sensor 25.

After this switch processing is performed, the indirect encoder sensor signal counter 330 counts the pulse outputted from the indirect encoder sensor 25 by the control of the position control counter part 5. When the indirect encoder sensor signal counter value is set to "30", the CPU 1 controls the driver part 8 to stop the drive operation of the motor 9. Thereby, the movement-of the transport belt 22 is stopped at the stop position with high accuracy.

Accordingly, by controlling the pulse count value of the direct encoder sensor 11 and the count value of the indirect encoder sensor 25 in combination, it is possible to carry out the drive control of the transport belt 22 with high accuracy. The count value which is outputted by the indirect encoder pulse sensor 25 and counted by the indirect encoder sensor signal counter 330 is reset to zero simultaneously when a pulse signal is outputted by the direct encoder sensor 11.

Figure 9:
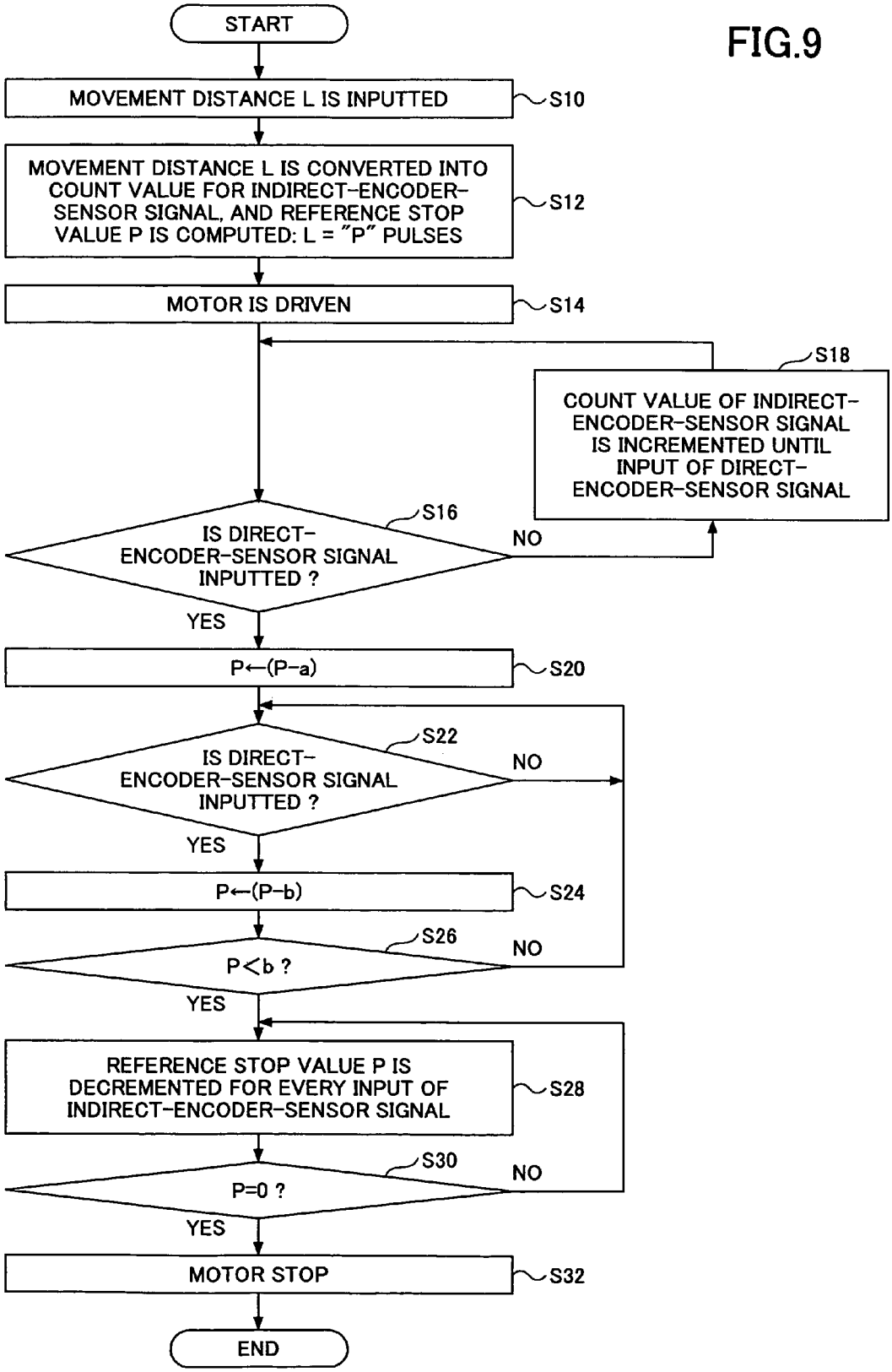
FIG. 9 is a flowchart for explaining the control processing of the transport belt drive control device in an embodiment of the invention.

FIG. 9 is a flowchart for explaining the drive control processing of the transport belt 22 which is performed by the CPU 1 of the transport belt drive control device of this embodiment based on the above-mentioned drive control processing.

The drive control processing of the transport belt 22 shown in FIG. 9 is started when a transport belt drive command is issued to the CPU 1.

Upon start of the drive control processing shown in FIG. 9, a movement distance L of the transport belt 22 which is requested for the current drive control processing is inputted at step S10.

At step S12, computation processing which converts the movement distance L into a reference stop value P which is a count value for the indirect encoder sensor 25 is performed so that the reference stop value P is computed. The correlations between movement distances of the transport belt 22 and count values of the indirect encoder sensor 25 are stored beforehand in the RAM 3.

When the reference stop value P is computed at step S12, the CPU 1 at step S14 starts driving of the motor 21 through the drive control part 7 and the driver part 8, so that the transport belt 22 starts movement and the recording medium 411 also starts movement. In connection with this, the CPU 1 controls the sensor input part 10 so that the CPU 1 performs the drive control of the transport belt 22 based on both the signal output from the direct encoder sensor 11 and the signal output from the indirect encoder sensor 25.

The CPU 1 at step S16 determines whether a direct encoder sensor signal is outputted from the direct encoder sensor 11. The processing of step S16 is continuously performed until a direct encoder sensor signal is outputted from the direct encoder sensor 11.

When the result of the determination at step S16 is negative, the control processing is transferred to step S18. Otherwise the control processing is transferred to step S20.

In the midst of the processing of step S16, the indirect encoder sensor signal from the indirect encoder sensor 25 having the high resolution is outputted.

At step S18, the indirect encoder sensor signal is counted by the position control counter part 5, and the CPU 1 increments the count value of the indirect encoder sensor signal. This count value will be called start complement count value a.

On the other hand, the CPU 1 at step S20 carries out subtraction processing to subtract the start complement count value a counted at step S18 from the reference stop value P computed at step S12 (P=(P−a)). The processing of step S20 is equivalent to the processing of (P=250−28=222) in the above-mentioned example of FIG. 8.

At step S22, the CPU 1 determines whether another direct encoder sensor signal is outputted after the first direct encoder sensor signal was outputted at step S16.

When it is determined that the direct encoder sensor signal is outputted at step S22, the control processing is transferred to step S24. The CPU 1 at step S24 carries out subtraction processing to subtract from the reference stop value P obtained at step S20 a count value b of the indirect encoder sensor 25 corresponding to the period of one pulse of the direct encoder sensor 11 (P=(P−b)). In the above-mentioned example of FIG. 8, the count value b is equal to b=64.

At step S26, the CPU 1 determines whether the reference stop value P obtained at step S24 is less than the count value b. The processing of steps 22-26 is repeated until the reference stop value P is less than the count value b.

On the other hand, when it is determined at step S26 that the reference stop value P is less than the count value b corresponding to 1 cycle, the control processing is transferred to step S28. At step S28, the CPU 1 performs decrement processing to decrement the reference stop value P obtained at step S24 every time an indirect encoder sensor signal is outputted from the indirect encoder sensor 25.

And whenever the decrement processing is performed, the CPU 1 at step S30 determines whether the reference stop value P is equal to zero. The processing of steps 28 and 30 is repeated until the reference stop value P is equal to zero.

When it is determined at step S30 that the reference stop value P is equal to zero, the CPU 1 at step S32 stops the driving of the motor 21 by controlling the drive control part 7 and the driver part 8, so that the movement of the transport belt 22 is stopped.

Accordingly, the transport belt 22 can be stopped with high accuracy at the position which is requested at step S10 as the movement distance L thereof, and therefore the position accuracy of the recording medium 411 carried on the transport belt 22 can be raised.

Figure 10:
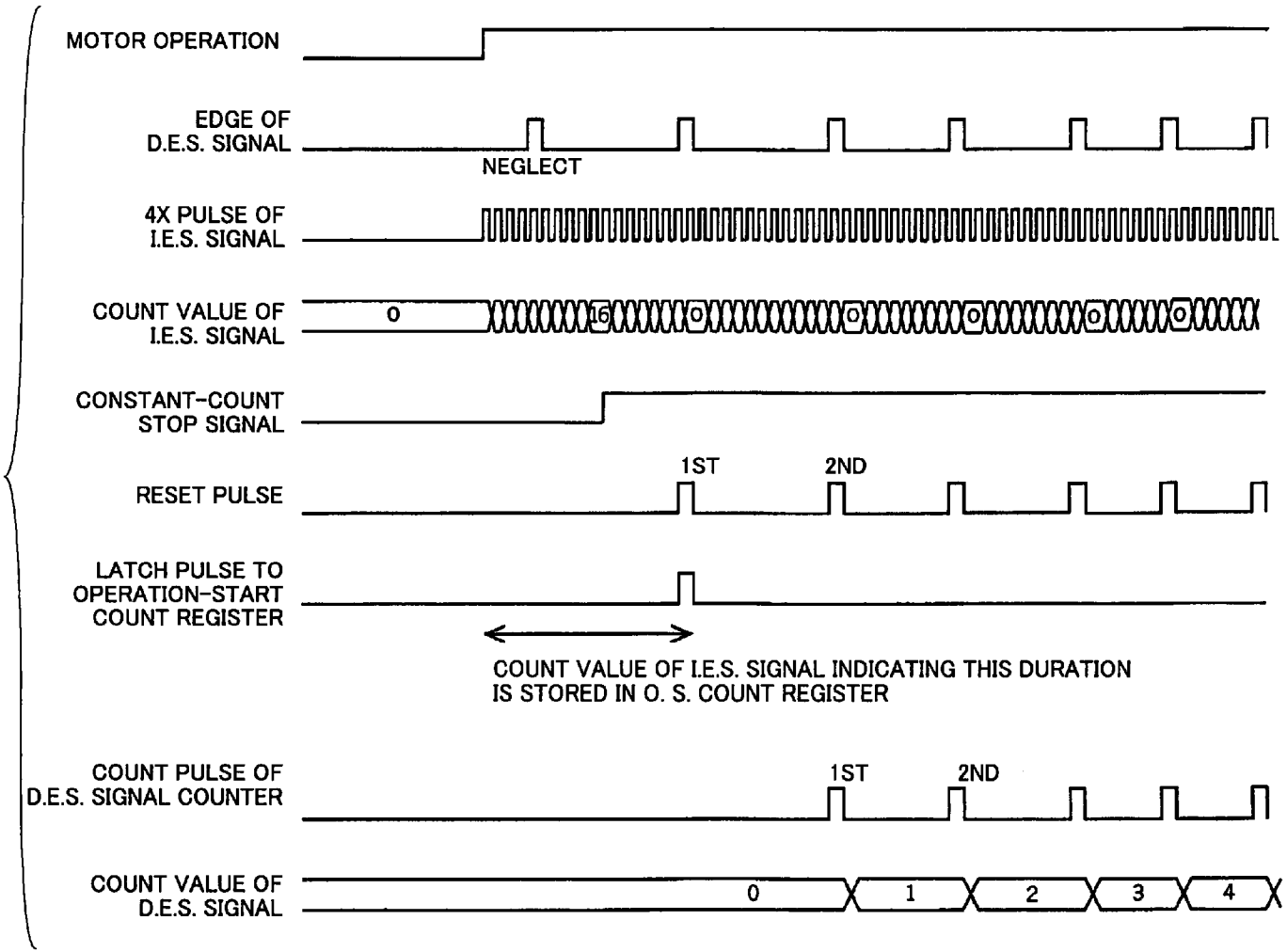
FIG. 10 is a timing chart for explaining operation of the image forming device in an embodiment of the invention at the time of start of the operation.

Next, FIG. 10 is a timing chart for explaining operation of the image forming device at the time of start of the operation in an embodiment of the invention.

In the following explanation, the elements which are essentially the same as corresponding elements in the embodiment of FIG. 3 through FIG. 9 are designated by the same reference numerals, and a description thereof will be omitted.

In the embodiment of FIG. 10, the image forming device is configured so that, after the counting of the indirect encoder sensor signal to the count value retained in the operation-start count register 34 is completed, the CPU 1 receives the edges of the direct encoder sensor signal. And, after that, a reset pulse to the counter 330 and a latch pulse to the register 34 are generated in accordance with a first edge of the direct encoder sensor signal.

The indirect encoder sensor signal counter 330 is reset to zero by the reset pulse, and the count value of the indirect encoder sensor signal counter 330 for the duration between the start of the operation and the reception of the first edge of the direct encoder sensor signal is retained in the operation-start count register 34 by the latch pulse. In short, the count value is complemented with the counter having the high resolution.

From the following edge of the direct encoder sensor signal, a count pulse to the direct encoder sensor signal counter 320 is generated, so that the direct encoder sensor signal counter 320 performs the counting of the direct encoder sensor signal.

Figure 11:
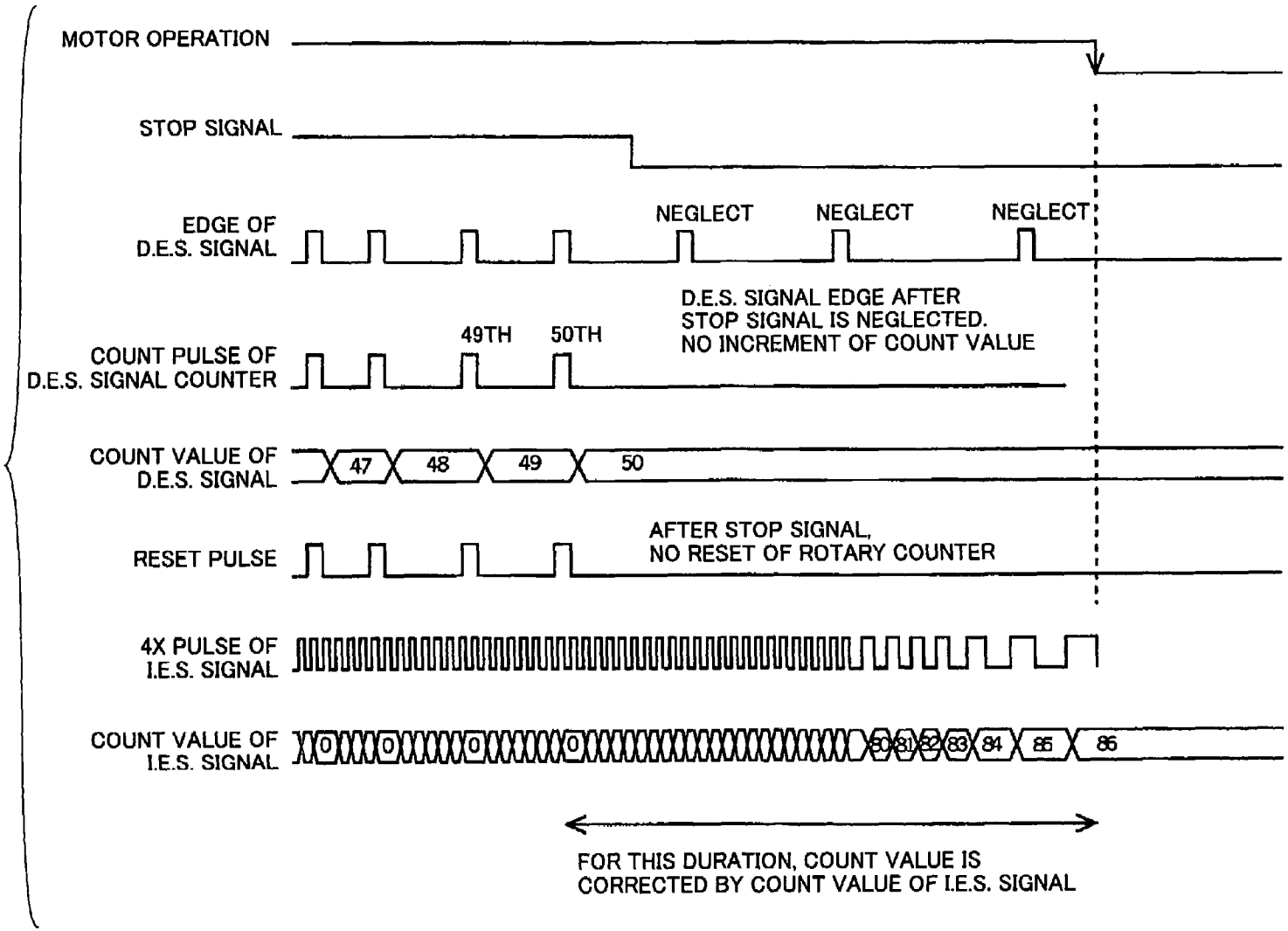
FIG. 11 is a timing chart for explaining operation of the image forming device in an embodiment of the invention at the time of stop of the operation.

On the other hand, FIG. 11 is a timing chart for explaining operation of the image forming device in an embodiment of the invention at the time of stop of the operation.

In the embodiment of FIG. 11, the image forming device is configured so that, after a stop signal occurs, the CPU 1 neglects the edge of the direct encoder sensor signal and does not generate the reset pulse to the counter 330 or the count pulse to the counter 320. Therefore, after the stop signal occurs, the count value is complemented with an indirect encoder sensor signal.

In the previous embodiment of FIG. 6, after the last direct encoder sensor signal is detected, the CPU 1 switches the direct detection of the feed amount of the transport belt 22 by the direct encoder sensor 11 to the indirect detection of the feed amount of the transport belt 22 by the indirect encoder sensor 25, so that the drive of the transport belt 22 is controlled based on only the output of the indirect encoder sensor 25.

However, in the present embodiment, the image forming device is configured so that, if the remainder of the count value indicated by the position control counter part 5 reaches a predetermined value (e.g., 100 pulses or 200 pulses), the CPU 1 compulsorily switches the direct detection by the direct encoder sensor 11 to the indirect detection by the indirect encoder sensor 25.

When stopping the transport belt 22, there may be a case in which the movement of the transport belt 22 is momentarily reversed to a direction opposite to the direction of the movement of the transport belt 22 by reaction of the stopping of the transport belt 22. The counter value of the indirect encoder sensor 25 may be decremented in response to the reverse feed amount of the transport belt 22 when the movement of the transport belt 22 is reversed.

However, according to the normal specifications, the count value of the direct encoder sensor 11 may not be decremented when the movement of the transport belt 22 is reversed. Although the processing to reverse the count value is not impossible, there is a possibility that some other problems take place due to the reversing of the count value. For this reason, by performing the above processing of FIG. 11, it is possible to perform the feed amount control (and the stop control) of the transport belt 22 more correctly.

Next, the image forming device in another embodiment of the invention will be explained with reference to FIG. 13 through FIG. 16.

In FIG. 13 through FIG. 16, the elements which are essentially the same as corresponding elements in the embodiment of FIG. 3 through FIG. 9 are designated by the same reference numerals, and a description thereof will be omitted.

Figure 12:
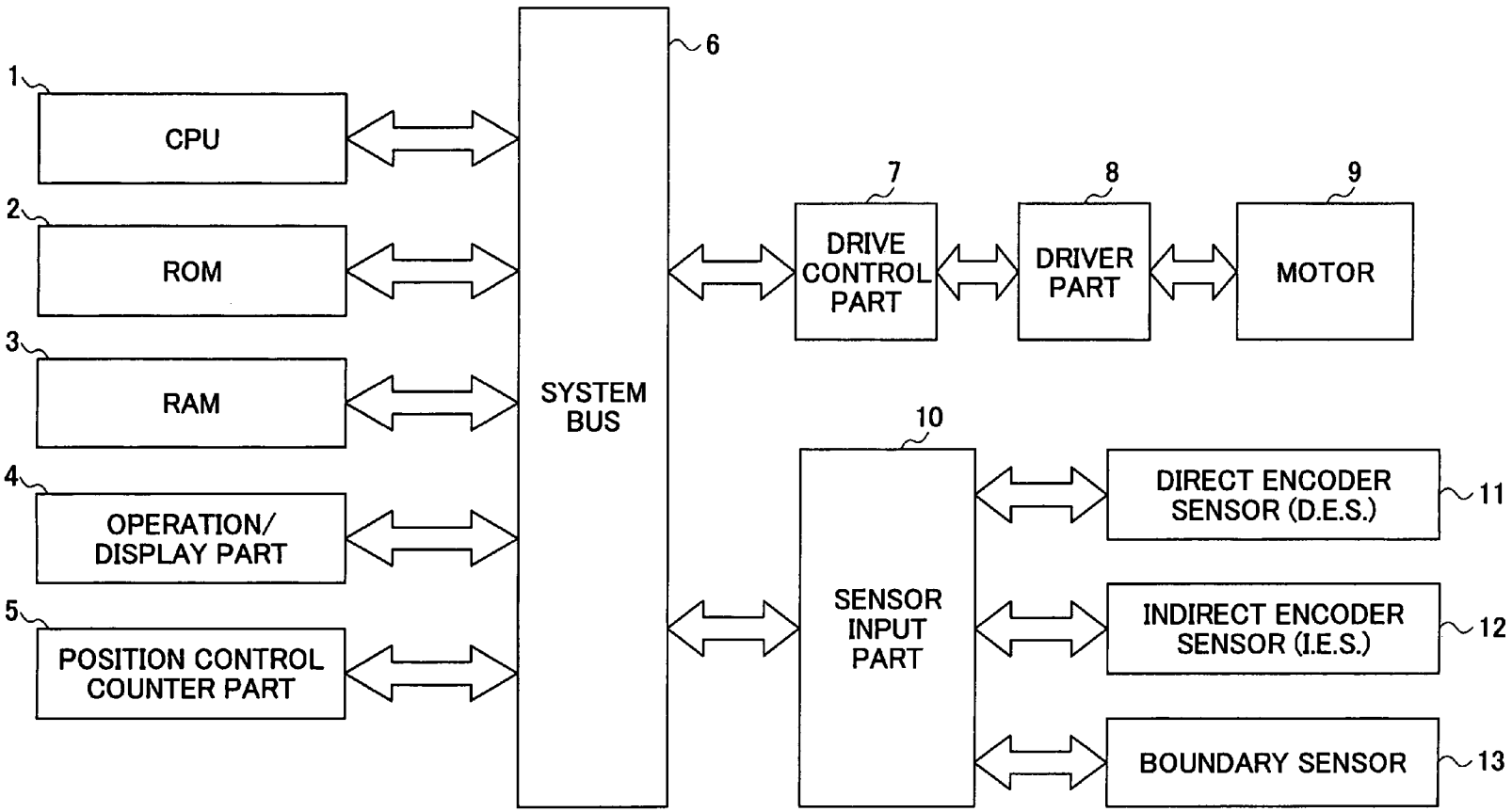
FIG. 12 is a block diagram showing the composition of an image forming device in an embodiment of the invention.
Figure 13:
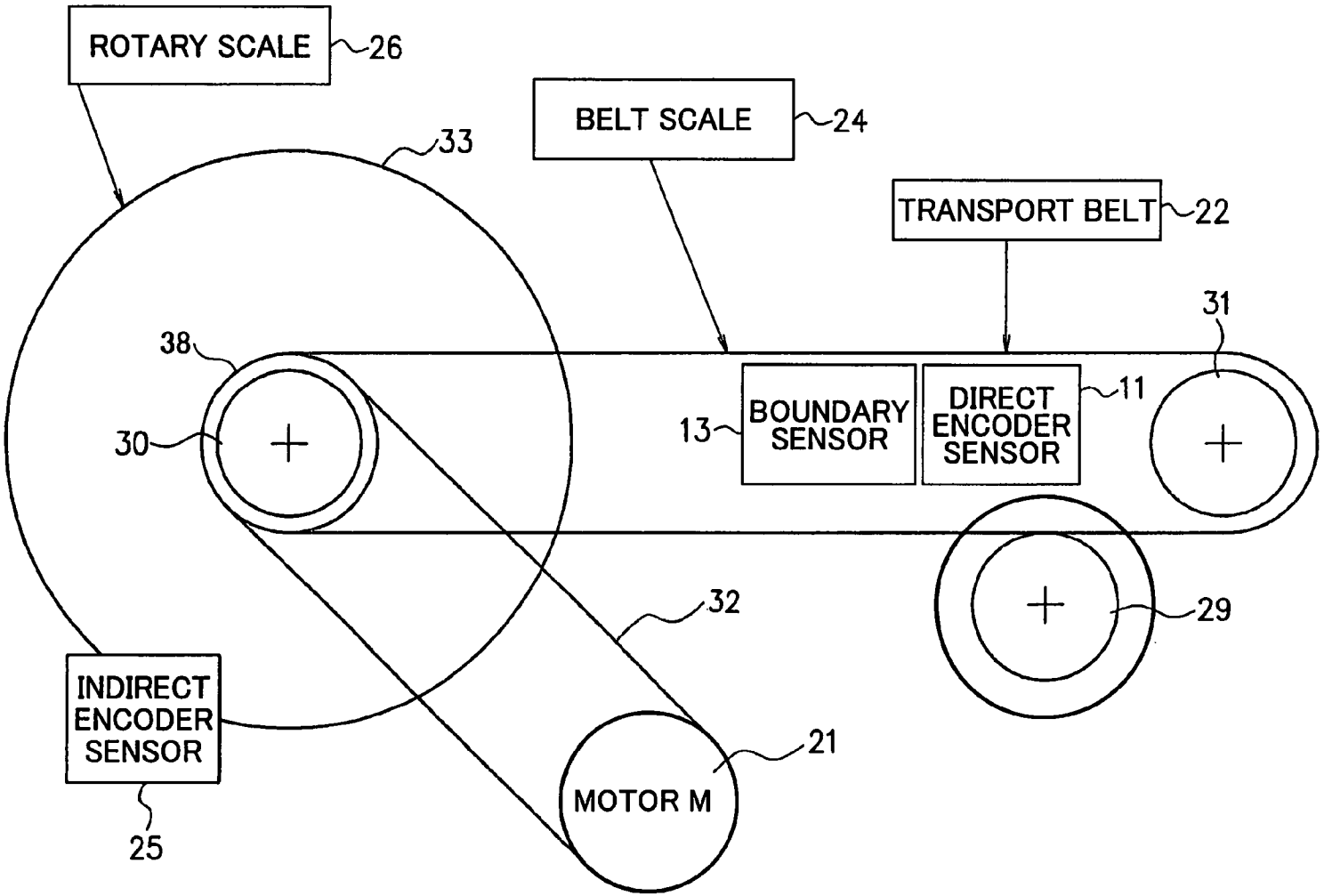
FIG. 13 is a block diagram of the recording medium transport part as a drive-system position control device in the image forming device.

As shown in FIG. 12 and FIG. 13, the image forming device in the present embodiment is configured so that a boundary sensor 13 is provided in addition to the above-mentioned composition of the image forming device in FIG. 4 and FIG. 5.

Figure 14:
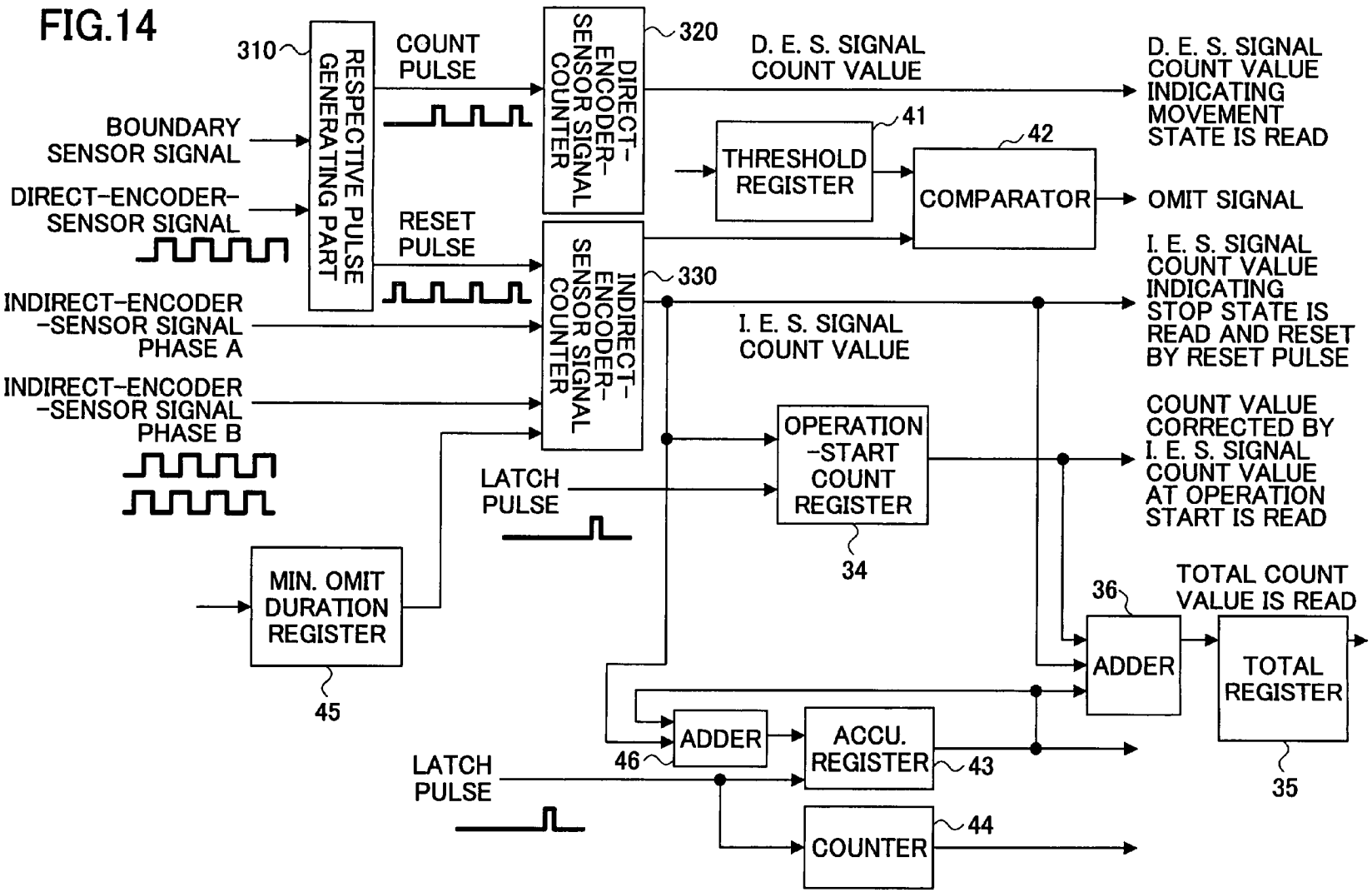
FIG. 14 is a block diagram showing the composition of the position control part of FIG. 13.

As shown in FIG. 14, the position control counter part in this embodiment is configured so that a threshold register 41, a comparator 42, an accumulation register 43, a counter 44, and a minimum omission duration register 45 are additionally provided in the position control counter part 5 of FIG. 6.

The boundary sensor 13 detects the boundary of the belt scale disposed on the back-side circumference of the transport belt 22 and outputs a boundary sensor signal. By receiving the boundary sensor signal, it is possible to detect the location of the transport belt 22 where a direct encoder sensor signal is likely to be missing.

The threshold register 41 is provided to retain a constant value A for detecting the omission of the output of the direct encoder sensor 11. This constant value A is set up in accordance with the count value indicated by the output of the indirect encoder sensor 25. Since the ratio of the output of the direct encoder sensor 11 and the output of the indirect encoder sensor 25 is set to a constant value, the constant value A is set up to a value that is larger than the value corresponding to the above-mentioned ratio. If the count value exceeds the constant value A and the next edge of the direct encoder sensor output is not detected, it is determined that the omission of the edge of the direct encoder sensor signal takes place.

Suppose a case in which the ratio of the output of the direct encoder sensor 11 and the output of the indirect encoder sensor 25 is 1:64. In this case, if direct encoder sensor 11 does not count even if the count value of the indirect encoder sensor 25 exceeds 90 (=the constant value A) and the next edge of the direct encoder sensor output is not detected, it is determined that the edge of the direct encoder sensor 11 is missing.

In the position control counter part of FIG. 14, the comparator 42 is provided to compare the count value of the indirect encoder sensor signal counter 330 with the constant value A which is retained in the threshold register 41. If the count value exceeds the constant value A, the omission signal, which indicates that the direct encoder sensor output is missing, is asserted.

The accumulation register 43 is provided to accumulate, at the time of the edge omission, the count value which is complemented with the indirect encoder sensor signal by the latch pulse, instead of the count value of the direct encoder sensor signal. The adder 46 adds the count value of indirect encoder sensor signal counter 33 to the count value of the accumulation register 43, and outputs the resulting sum to the accumulation register 43.

The counter 44 is provided to latch, at the time of edge omission, the count value which is complemented with the indirect encoder sensor signal, instead of the count value of the direct encoder sensor signal, in accordance with the latch pulse. The minimum omission duration register 45 is provided to set up a certain omission range if the edge is missing. The minimum omission duration register 45 is provided to prevent repeated counting of the direct encoder sensor signal or the indirect encoder sensor signal. Since the direct encoder sensor signal and the indirect encoder sensor signal are asynchronous, the repeated counting causes accumulation of small errors.

Figure 15:
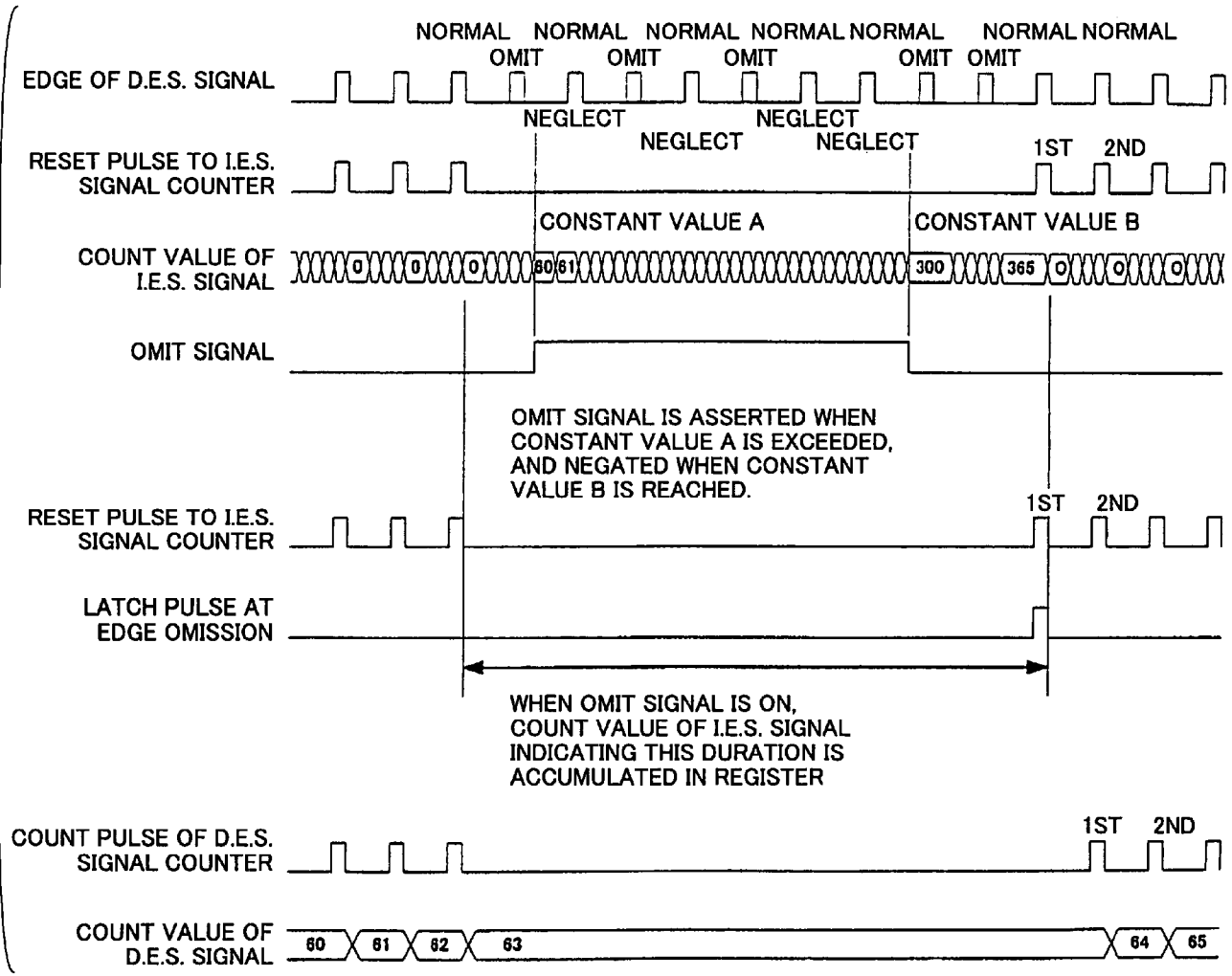
FIG. 15 is a timing chart for explaining operation of the image forming device at the time of omission of a direct encoder sensor output.

Next, FIG. 15 is a timing chart for explaining operation of the image forming device in this embodiment at the time of omission of a direct encoder sensor signal.

The basic positioning control in this embodiment is to perform the positioning control based on the count value of the direct encoder sensor signal which is the output of the direct encoder sensor 11 having the low resolution.

The direct encoder sensor 11 detects the movement of the transport belt 22 directly, and the component accuracy errors and the installation accuracy errors, such as eccentricity or deflection, can be canceled by using the output of the direct encoder sensor 11. However, there is some difficulty in changing the direct detection by the direct encoder sensor 11 to a high-resolution configuration.

For this reason, in this embodiment, the output of the indirect encoder sensor 25 having the high resolution to detect the movement of the transport belt 22 indirectly is used in combination of the output of the direct encoder sensor 11. Since the direct detection of a difference between the pulses of low resolution (or a difference between the signal edges) with the output of the direct encoder sensor 11 having the low resolution is impossible, the output of the indirect encoder sensor 25 having the high resolution is used to complement the limitation of the direct detection by the direct encoder sensor 11. That is, the positioning control is performed by combination of the count value of the direct encoder sensor signal and the count value of the indirect encoder sensor signal.

The stop or restart of the movement of the transport belt 22 is likely to occur at an intermediate position between the pulses of low resolution (or between the signal edges). In the embodiment of FIG. 15, the image forming device is configured so that the CPU 1 performs, for a duration between the start of the operation and the first edge of the low-resolution sensor output signal, the counting of the high-resolution output signal of the indirect encoder sensor 25, and the resulting count value is latched to the operation-start count register 34.

The counting of the low-resolution output signal of the direct encoder sensor 11 is stopped just before the time of stop of the movement, and simultaneously the resetting of the indirect encoder sensor signal counter 330 is stopped. The CPU 1 performs, for the duration prior to the stop of the movement, the counting of the high-resolution output signal of the indirect encoder sensor 25, and the count value is thus complemented.

And by using the adder 36 and the sum total register 35, the sum of the count value mentioned above and the value retained in the operation-start count register 34 is obtained. Thus, it is possible to obtain the total of the count value complemented with the indirect encoder sensor 25 having the high resolution.

Since the ratio of the output of the direct encoder sensor 11 and the output of the indirect encoder sensor 25 is set to a constant value, the constant value A is set up to a value that is larger than the value corresponding to the above-mentioned ratio. If the count value exceeds the constant value A and the next edge of the direct encoder sensor output is not detected, it is determined that the omission of the edge of the direct encoder sensor signal takes place.

In the embodiment of FIG. 15, the omission signal is asserted when the count value exceeds the constant value A retained in the threshold register 41 and the following edge of the direct encoder sensor signal is not detected. Once the omission signal is asserted, the CPU 1 does not receive a direct encoder sensor signal until the constant value B retained in the minimum omission duration register 45 is reached. That is, even if the direct encoder sensor signal is detected before the constant value B is reached, it is neglected. And the omission signal is negated if the constant value B is reached.

If a direct encoder sensor signal is detected after the negation of the omission signal, the counter value of the indirect encoder sensor signal for the duration between the reset pulse prior to the assertion of the omission signal and the first reset pulse following the negation of the omission signal, indicated by the arrow in FIG. 15 is accumulated in the accumulation register 43. And the number of times of the omission is counted by the counter 44, and the resulting count value is displayed.

Figure 16:
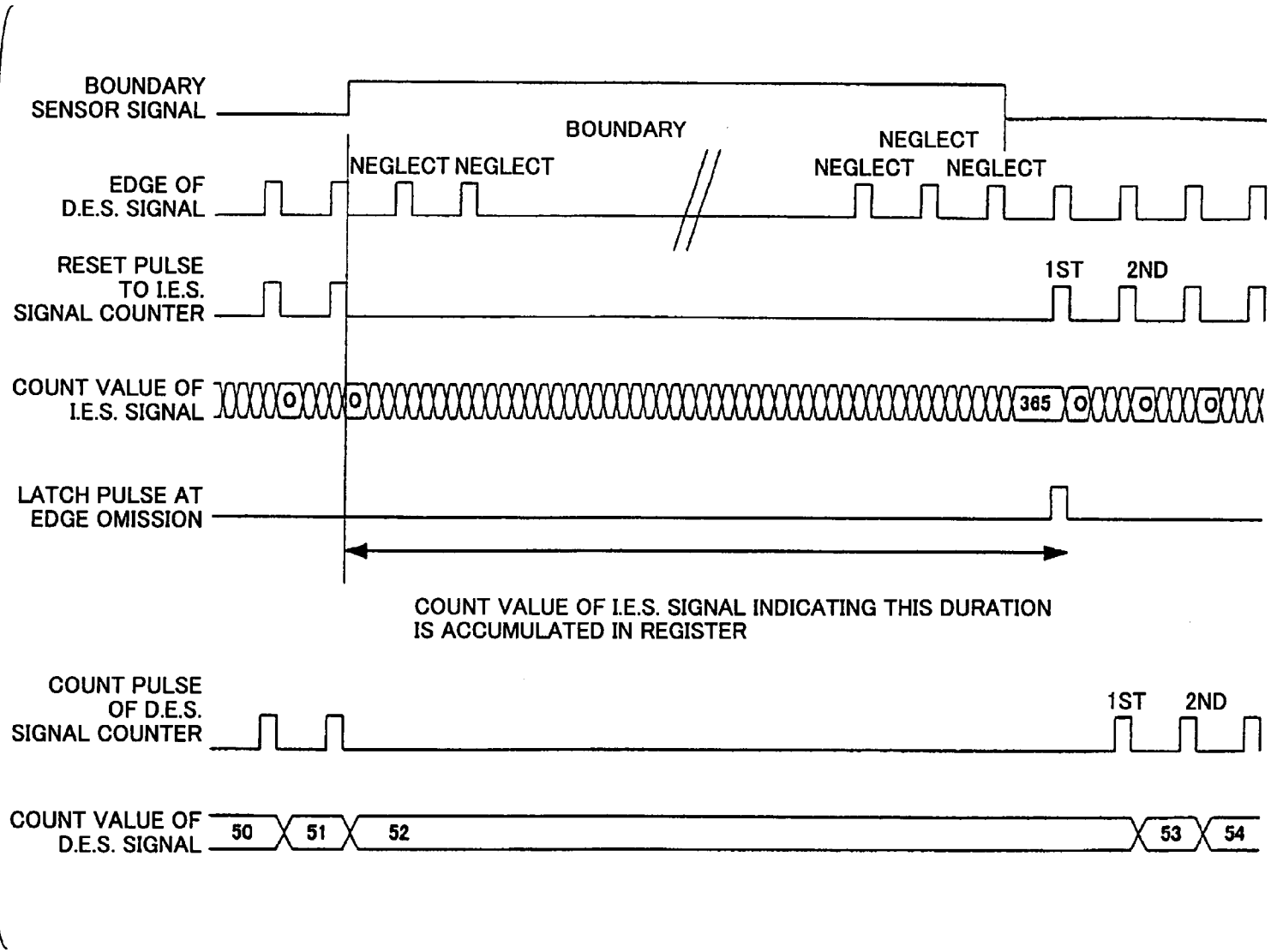
FIG. 16 is a timing chart for explaining operation of the image forming device at the time of detection of a boundary sensor signal.

Next, FIG. 16 is a timing chart for explaining operation of the image forming device at the time of detection of a boundary sensor signal.

The direct encoder sensor 11 shown in FIG. 13 detects the movement of the transport belt 22 directly. However, dusts or ink particles may adhere to the belt scale 24 which is formed on the transport belt 22 by vapor deposition or printing. In such cases, it is difficult to detect the output of the direct encoder sensor 22 correctly.

Moreover, sticking the scale lines of the belt scale 24 to the transport belt at equal intervals seamlessly is difficult, and the boundary of the belt scale 24 arises inevitably. For the duration of detecting the boundary, it is difficult to detect the output of the direct encoder sensor 22 correctly. In this case, if the count value is complemented with the indirect encoder sensor 25, the duration for which the counting of the output signal of the direct encoder sensor 11 is impossible can be complemented In the example of FIG. 16, the boundary sensor 13 and the direct encoder sensor 11 shown in FIG. 13 read the belt scale 24 simultaneously. When the time of reading by the boundary sensor 13 precedes the time of reading by the direct encoder sensor 11, it is necessary to delay the use of a boundary sensor signal.

Fundamentally, when the boundary sensor signal is asserted, the counting of the direct encoder sensor signal is not performed since the missing or unstable state of the edge of the direct encoder sensor signal is likely to take place. Rather, the counting of the indirect encoder sensor signal is performed and thereby the count value is complemented. The complemented count value is accumulated in the accumulation register 43. And the number of times of the omission is counted by the counter 44, and the resulting count value is displayed.

In the drive control device of the above-described embodiment, the threshold register 41 is provided for the judgment of whether any omission of a direct encoder sensor output signal takes place. The count value of the indirect encoder sensor signal is compared with the constant value A retained in the threshold register 41. The omission signal is asserted when the count value exceeds the constant value A. When the output of the direct encoder sensor 11 is recovered, the count value of the indirect encoder sensor signal obtained during the omission of the direct encoder sensor output signal is stored in the accumulation register 43.

Accordingly, even when dusts or ink particles adhere to the transport belt 22 and the output of the direct encoder sensor 11 is missing, it is possible for the present embodiment to perform the feed amount control and stop control of the transport belt with high accuracy by using the count value of the output of the indirect encoder sensor 25.

The low-resolution problem of the direct encoder sensor 11 can be compensated by using the output of the indirect encoder sensor 25. Since the control of the feed amount of the transport belt 22 is mainly performed by using the output of the direct encoder sensor 11, it is possible to carry out fine positioning control of the transport belt 22 which is not influenced by installation accuracy errors, component accuracy errors, such as eccentricity, deflection or temperature changes, etc.

In the drive control device of the above-described embodiment, the minimum omission duration register 45 is provided to detect the omission of a direct encoder sensor signal. If the omission of the direct encoder sensor signal, the counting of the indirect encoder sensor signal is continuously performed until the value of this register is exceeded. The dusts, ink particles, etc. which exist intermittently on the belt can be treated as the omission of to the signal. Therefore, it is possible to prevent the repeated counting of the direct encoder sensor signal or the indirect encoder sensor signal.

Since the direct encoder sensor signal and the indirect encoder sensor signal are asynchronous, the repeated counting may cause the accumulation of small errors. Therefore, it is possible to reduce the accumulation of small errors due to the asynchronous signals. Consequently, it is possible to carry out fine positioning control which is not influenced by installation accuracy errors, component accuracy errors, such as eccentricity, deflection or temperature changes, etc.

The accumulation register 43 is updated for every omission of the signal edge, and the count value is accumulated in the accumulation register 43. It is unnecessary that the value retained in a separate register is read and the read value is added. Moreover, the counter 44 is provided to count the number of times of the omission, and the resulting count value is displayed. It is possible to detect the staining condition of the transport belt 22 by the count value indicating the number of times of the omission.

Simultaneously when the output of the direct encoder sensor 11 is counted, the count value of the output signal of the indirect encoder sensor 25 is reset. The output of the indirect encoder sensor 25 is always synchronized with the output of the direct encoder sensor 11. It is possible to take corrective actions whenever the output of the direct encoder sensor 11 is missing.

According to the above-mentioned embodiments, the positioning control of the transport belt on which the recording medium is carried is performed using the direct detection by the direct encoder sensor having a low resolution and the indirect detection by the indirect encoder sensor having a high resolution in combination, it is possible to perform the feed amount control and stop control of the transport belt with high accuracy and without the influences of mechanical errors. The image forming device of the invention is applicable to office printers, facsimiles and copiers in which the ink jet engine is provided with good light resistance, good picture quality and high reliability.

The present invention is not limited to the above-described embodiments, and variations and modifications may be made without departing from the scope of the present invention.

Further, the present application is based on and claims the benefit of priority of Japanese patent application No. 2004-331089, filed on Nov. 15, 2004, and Japanese patent application No. 2005-315060, filed on Oct. 28, 2005, the entire contents of which are hereby incorporated by reference.

What is claimed is:

1. A transport belt drive control device comprising:

a first detection unit having a first resolution and indirectly detecting a feed amount of a transport belt;

a control unit controlling drive of the transport belt based on an output of the first detection unit; and a second detection unit having a second resolution lower than the first resolution and directly detecting the feed amount of the transport belt, wherein the control unit is configured to switch, when it is determined that an output of the second detection unit having the second resolution does not allow detection of a stop position of the transport belt, the direct detection of the transport belt feed amount by the second detection unit to the indirect detection of the transport belt feed amount by the first detection unit, so that the drive of the transport belt is controlled based on the output of the first detection unit.

2. The transport belt drive control device of claim 1 wherein the first detection unit comprises:

a rotary scale disposed with a given interval on a circumference of a disc attached to a revolving shaft driving the transport belt;

an indirect encoder generating an output signal whenever the rotary scale is detected; and an indirect counter counting the output signal of the indirect encoder.

3. The transport belt drive control device of claim 1 wherein the second detection unit comprises:

a belt scale disposed with a given interval on a circumference of the transport belt;

a direct encoder generating an output signal whenever the belt scale is detected; and a direct counter counting the output signal of the direct encoder.

4. The transport belt drive control device of claim 1 wherein the control unit comprises:

a computation unit computing a reference stop value based on a given stop position of the transport belt, the reference stop value indicating a movement amount of the transport belt for the given stop position and being expressed as a corresponding count value of the indirect encoder;

a subtraction unit subtracting from the reference stop value a count value of the indirect counter equivalent to a single count of the direct counter every time a count value of the direct counter is incremented; and a stopping unit stopping the transport belt when a result of the subtraction from the reference stop value is below the count value of the indirect counter equivalent to the single count of the direct counter and a resulting count value of the indirect counter is equal to the result of the subtraction from the reference stop value.

5. The transport belt drive control device of claim 4 wherein the stopping unit is configured to decrement a result of the subtraction from the reference stop value whenever a count value of the indirect counter is incremented, and to stop the transport belt when the result of the subtraction from the reference stop value is equal to zero.

6. The transport belt drive control device of claim 1 wherein the first detection unit comprises an indirect counter counting an output signal generated by an indirect encoder whenever a rotary scale is detected, the second detection unit comprises a direct counter counting an output signal generated by a direct encoder whenever a belt scale is detected, and the control unit comprises a reset unit resetting a count value of the indirect counter whenever a count value of the direct counter is incremented.

7. The transport belt drive control device of claim 1 wherein the first detection unit comprises an indirect counter counting an output signal generated by an indirect encoder whenever a rotary scale is detected, the second detection unit comprises a direct counter counting an output signal generated by a direct encoder whenever a belt scale is detected, and the control unit is configured to subtract a count value of the indirect counter equivalent to a single count of the direct counter from the reference stop value after a feed amount control of the transport belt is started and before a count value of the direct counter is changed.

8. An image forming device in which an image recording unit forms an image on a recording medium transported by a transport belt, and a transport belt drive control device controls drive of the transport belt, the transport belt drive control device comprising:

a first detection unit having a first resolution and indirectly detecting a feed amount of a transport belt;

a control unit controlling the drive of the transport belt based on an output of the first detection unit; and a second detection unit having a second resolution lower than the first resolution and directly detecting the feed amount of the transport belt, wherein the control unit is configured to switch, when it is determined that an output of the second detection unit having the second resolution does not allow detection of a stop position of the transport belt, the direct detection of the transport belt feed amount by the second detection unit to the indirect detection of the transport belt feed amount by the first detection unit, so that the drive of the transport belt is controlled based on the output of the first detection unit.

9. A transport belt drive control method comprising steps of:

providing a first detection unit having a first resolution and indirectly detecting a feed amount of a transport belt;

controlling drive of the transport belt based on an output of the first detection unit; and providing a second detection unit having a second resolution lower than the first resolution and directly detecting the feed amount of the transport belt, wherein the controlling step is configured to switch, when it is determined that an output of the second detection unit having the second resolution does not allow detection of a stop position of the transport belt, the direct detection of the transport belt feed amount by the second detection unit to the indirect detection of the transport belt feed amount by the first detection unit, so that the drive of the transport belt is controlled based on the output of the first detection unit.

10. The transport belt drive control method of claim 9 wherein the first detection unit comprises an indirect counter counting an output signal generated by an indirect encoder whenever a rotary scale is detected, and the second detection unit comprises a direct counter counting an output signal generated by a direct encoder whenever a belt scale is detected, and wherein the controlling step comprises:

computing a reference stop value based on a given stop position of the transport belt, the reference stop value indicating a movement amount of the transport belt for the given stop position and being expressed as a corresponding count value of the indirect encoder;

subtracting from the reference stop value a count value of the indirect counter equivalent to a single count of the direct counter every time a count value of the direct counter is incremented; and stopping the transport belt when a result of the subtraction from the reference stop value is below the count value of the indirect counter equivalent to the single count of the direct counter and a resulting count value of the indirect counter is equal to the result of the subtraction from the reference stop value.

* * * * *